US008109225B2

(12) United States Patent
McCudden et al.

(10) Patent No.: US 8,109,225 B2
(45) Date of Patent: Feb. 7, 2012

(54) BANNER SUPPORT SYSTEM

(76) Inventors: Lachlan Arthur Dean McCudden, New South Wales (AU); Arthur Lachlan McCudden, New South Wales (AU)

( * ) Notice: Subject to any disclaimer, the term of this patent is extended or adjusted under 35 U.S.C. 154(b) by 399 days.

(21) Appl. No.: 11/990,961

(22) PCT Filed: Aug. 25, 2006

(86) PCT No.: PCT/AU2006/001239

§ 371 (c)(1),
(2), (4) Date: Jan. 2, 2009

(87) PCT Pub. No.: WO2007/022596

PCT Pub. Date: Mar. 1, 2007

(65) Prior Publication Data

US 2009/0145013 A1 Jun. 11, 2009

(30) Foreign Application Priority Data

Aug. 25, 2005 (AU) ..... 2005904626
Sep. 5, 2005 (AU) ..... 2005904849

(51) Int. Cl.
*G09F 17/00* (2006.01)
*E04H 12/32* (2006.01)

(52) U.S. Cl. ..... 116/173

(58) Field of Classification Search ..... 116/173, 116/174

See application file for complete search history.

(56) References Cited

U.S. PATENT DOCUMENTS

| | | | | | |
|---|---|---|---|---|---|
| 1,416,669 | A * | 5/1922 | Allman | 116/173 |
| 1,645,645 | A * | 10/1927 | Davis | 116/173 |
| 2,377,219 | A * | 5/1945 | Ellis | 116/173 |
| 3,300,185 | A * | 1/1967 | Metzger et al. | 116/173 |
| 4,889,321 | A * | 12/1989 | Burns | 254/332 |
| 5,454,202 | A * | 10/1995 | van der Weijden | 116/173 |
| 5,884,578 | A * | 3/1999 | Thostrup et al. | 116/174 |
| 5,983,825 | A * | 11/1999 | Nowak et al. | 116/173 |
| 6,484,992 | B1 * | 11/2002 | Svensson et al. | 116/173 |
| 7,530,325 | B2 * | 5/2009 | Swenson et al. | 116/173 |
| 2003/0010274 | A1 * | 1/2003 | McCudden et al. | 116/173 |

FOREIGN PATENT DOCUMENTS

| | | | |
|---|---|---|---|
| DE | 2457945 | A * | 6/1976 |
| DE | 4141688 | A1 * | 6/1993 |
| DE | 20303861 | U1 * | 5/2003 |
| EP | 905335 | A1 * | 3/1999 |
| FR | 2672630 | A1 * | 8/1992 |
| JP | 2001056655 | A | 2/2001 |
| NL | 9301343 | A * | 2/1995 |
| WO | WO 96/33482 | A1 | 10/1996 |
| WO | WO 2004/097118 | A2 | 11/2004 |

* cited by examiner

*Primary Examiner* — Richard A. Smith
(74) *Attorney, Agent, or Firm* — Stinson Morrison Hecker LLP

(57) ABSTRACT

A banner raising apparatus is described for use with a halyard (228) for raising and lowering a banner. The apparatus is mounted to a generally vertical support surface (222) and comprises an upper halyard guide (220) mounted at an upper portion of the support surface and guiding the halyard travelling in a secure halyard passageway. A halyard fastener (218) is operable to releasably fasten the halyard exiting the secure halyard passageway adjacent a lower portion of the support surface, and a secure housing (212) is mounted externally of the support surface adjacent the lower portion, the secure housing configured to contain the halyard fastener and having sufficient internal volume to securely house the halyard of a raised banner. The secure housing is configured to enable access to the halyard. An elongate conduit defining the secure halyard passageway may be mounted externally to the support surface. The secure halyard passageway may be a secure internal cavity defined in the support surface.

16 Claims, 13 Drawing Sheets

BANNER SUPPORT SYSTEM

FIELD OF THE INVENTION

The present invention relates generally to apparatuses for raising and supporting banners, flags and objects of a similar nature and, more particularly, to banner raising apparatuses which inhibit unauthorised operation, tampering or theft of the raised object.

BACKGROUND OF THE INVENTION

Banners, flags and objects of a similar nature are widely used to convey information and provide aesthetic appeal. Such banners are typically suspended at a height so that the banner is prominent and visible from some distance. It is well known that devices such as flag poles and banner poles, whether standing on the ground or mounted on a wall, building or other surface, can be used to suspend banners. Due to the prominence, symbolic significance and typically publicly accessible location of banners, they are often the target of unauthorised operation or tampering, such as vandalism or theft.

A method well known in the art for attaching a banner to a banner pole at a height is the use of a halyard or similar device. The halyard allows a person to attach the banner to the halyard at ground level and then raise the banner to the appropriate height using the halyard and an elevated guiding arrangement. A disadvantage of the halyard is that a thief or vandal can also access the halyard at ground level and use the halyard to lower and steal or vandalise the banner.

It is understood in the art that the disadvantage of poor security can be mitigated by enclosing a portion of the halyard in the banner pole, such that unauthorised access to, and operation of, the halyard by a thief or vandal is inhibited. Access to the halyard can be provided via a security hatch, such as a locked door, in the banner pole which can only be opened using a security device, such as a key.

It is not always possible to enclose the halyard in the banner pole or to access the inside of the banner pole. The banner pole may not be hollow, for instance, in the case of wooden or concrete telegraph poles. Alternatively, a person may wish to attach a banner to a structure other than a banner pole, for instance, a solid wall or column.

Even if a banner is to be attached to a hollow pole, it still may not be possible to enclose the halyard in the pole or to access the interior of the pole. In the case of street light poles, the authority responsible for the poles may not permit access to, or a halyard to be located in, the inside of the light poles. Additionally, light poles may have internal contents, such as electrical wiring, which the halyard could damage or interfere with.

Where the halyard is not enclosed in the banner pole and is external to the banner pole, it is exposed to unauthorised access by thieves or vandals and the banner is accordingly vulnerable.

An alternate method for raising banners well known in the art is the use of a lifting device, such as a cherry picker. The lifting device can be used to lift a person holding a banner to the appropriate height on a banner pole. The person then attaches and secures the banner to the banner pole. This method offers improved banner security. By eliminating the halyard, a lifting device is required to access, raise or lower the banner. The banner cannot be readily accessed by thieves or vandals from the ground level.

However the use of a lifting device has a number of disadvantages. To raise or lower a banner, a lifting device may need to be hired and operated by trained personnel at significant cost. The lifting device must be manoeuvred into place, often taking some time and causing disruption to the area surrounding the banner pole. For instance, in the case of banner poles located next to a roadway, traffic on the roadway may be disrupted and, to minimise such disruption, the lifting device may only be deployed at night.

Any discussion in the present specification of documents, publications, acts, devices, substances, articles, materials and the like is included for the purpose of providing a context for the present invention and is not an admission that the subject matter of the discussion forms part of the prior art base, or is part of the common general knowledge of the technical field relevant to the present invention, as at the relevant priority date or dates.

SUMMARY OF THE INVENTION

According to a first aspect of the invention there is provided a banner raising apparatus adapted to be used in conjunction with a halyard for raising and lowering a banner, the apparatus adapted to be mounted to a generally vertical support surface, the apparatus comprising:

an upper halyard guide adapted to be mounted at an upper portion of the support surface and arranged to guide the halyard travelling in a secure halyard passageway;

a halyard fastener operable to releasably fasten the halyard exiting the secure halyard passageway adjacent a lower portion of the support surface; and a secure housing adapted to be mounted externally of the support surface adjacent the lower portion, the secure housing configured to contain the halyard fastener, the secure housing having an internal volume of sufficient capacity to securely house the halyard of a raised banner, wherein the secure housing is configured to enable access to the halyard.

According to a second aspect of the invention there is provided a banner raising apparatus adapted to be used in conjunction with a halyard for raising and lowering a banner, the apparatus adapted to be mounted to a generally vertical support surface, the apparatus comprising:

(a an elongate conduit defining a secure halyard passageway, the conduit adapted to be mounted to a support surface so as to extend generally vertically up the support surface;

(b a halyard guide located at the operatively upper end of the elongate conduit for guiding a halyard travelling in the secure halyard passageway;

(c a halyard fastener for releasably attaching the halyard, the halyard fastener located at the operatively lower end of the elongate conduit; and (d a secure housing located at the operatively lower end of the elongate conduit, the housing containing the halyard fastener and having an internal volume of sufficient capacity to contain the halyard of a raised banner therein.

According to a further aspect of the invention there is provided an internal halyard system adapted to be mounted to a generally vertical pole which defines a secure internal cavity, the system being adapted to be used in conjunction with a halyard for raising and lowering a banner, the system comprising:

(a) an upper halyard guide configured to guide the halyard travelling vertically inside the secure internal cavity to exit the internal cavity, the upper halyard guide adapted to be mounted to an upper portion of the pole;

(b) a lower halyard guide configured to guide the halyard travelling vertically inside the secure internal cavity to exit the internal cavity laterally, the lower halyard guide adapted to be mounted to a lower portion of the pole;

(c) a halyard attachment means adapted to be mounted externally of the pole adjacent the lower halyard guide and adapted to have a halyard exiting the internal cavity releasably attached thereto; and (d) a secure housing adapted to be mounted at the lower portion of the pole, the secure housing configured to contain the halyard attachment means, the secure housing having an internal volume of sufficient capacity to securely house the halyard of a raised banner in the secure housing and being configured to enable the halyard to be accessed for the purposes of raising and lowering a banner.

According to a further aspect of the invention there is provided a method for converting a generally vertical pole which defines a secure internal cavity into a banner pole, the method comprising the steps of:

(a) forming an upper hole in an upper portion of the pole into the secure cavity and a lower hole in a lower portion of the pole into the secure cavity;

(b) mounting to an upper halyard guide into the secure internal cavity, the upper halyard guide configured to guide the halyard travelling vertically inside the secure internal cavity to exit the internal cavity through the upper hole;

(c) mounting a lower halyard guide into the secure internal cavity, the lower halyard guide configured to guide the halyard travelling vertically inside the secure internal cavity to exit the secure internal cavity laterally through the lower hole;

(d) mounting a halyard attachment means externally to the secure internal cavity adjacent the lower halyard guide for releasably attaching a halyard exiting the internal cavity;

(e) mounting a secure housing at the lower portion of the pole to enclose the halyard attachment means, the secure housing having an internal volume of sufficient capacity to securely house the halyard of a raised banner in the secure housing and being configured to enable the halyard to be accessed for the purposes of raising and lowering a banner;

(f) providing a halyard with one end adapted to connect to an upper end of a banner; and (g) threading the halyard through the upper halyard guide, through the internal cavity and through the lower halyard guide.

According to a further aspect of the invention there is provided a method for converting a structure which has at least one generally vertical support surface to a secure banner raising apparatus to be used in conjunction with a halyard for raising and lowering a banner, the method comprising the steps of:

(a mounting a banner raising apparatus according to any one of claims to the vertical support surface so that the elongate conduit extends generally vertically up the support surface;

(b providing a halyard with one end adapted to connect to an upper end of a banner; and (c threading the halyard through the halyard guide and the halyard passageway.

According to a further aspect of the invention there is provided a banner support apparatus for supporting a banner an adapted to be mounted to a generally vertical support surface, the banner support apparatus comprising:

an elongate member adapted to be mounted generally orthogonally to the support surface and operable to support the banner; and a pivoting support adapted to support the elongate member, the elongate member being rotatable about the pivoting support, wherein the pivoting support comprises a spring arranged to urge the elongate member back towards an initial position if the elongate member is rotated away from the initial position.

BRIEF DESCRIPTION OF THE DRAWINGS

Embodiments of the invention are described, by way of example only, with reference to the accompanying drawings in which.

DETAILED DESCRIPTION OF THE EMBODIMENTS

Figure 1:
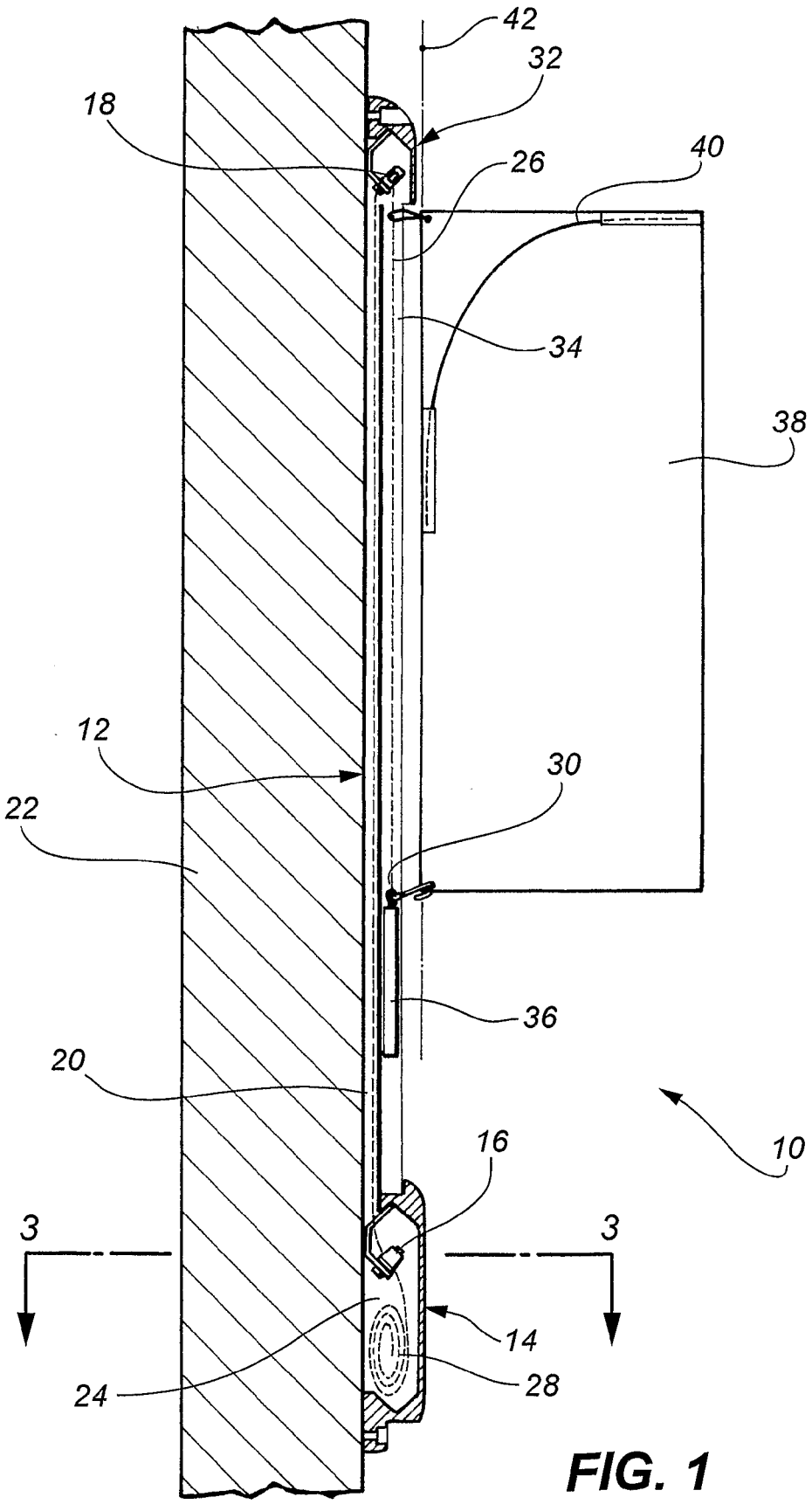
FIG. 1 shows a cross sectional side view of a first arrangement in which a banner raising arrangement is attached to a support surface.

The following description refers to preferred embodiments of the present invention. To facilitate an understanding of the present invention, reference is made to the accompanying drawings which illustrate preferred embodiments of the present invention. For ease of communication, similar components between the drawings are identified by the same reference numerals.

Arrangements Mounted to a Support Surface

FIG. 1 of the accompanying drawings shows a cross sectional view of a banner raising apparatus in the operative state. A banner raising apparatus 10 is depicted. The banner raising apparatus 10 has an elongate conduit 12 which may be a pipe, channel or similar shape. When the elongate conduit 12 is mounted to a support surface 22, it has an internal secure halyard passageway 20 which cannot be accessed externally. Located at the lower end of the elongate conduit is a secure housing 14 which contains a halyard fastener 16 and has an internal volume 24 for storing a portion of a halyard 26. An opening in the operatively upper end of the secure housing 14 provides internal access from the interior of the secure housing 14 to the interior of the secure halyard passageway 20. Preferably the elongate conduit 12 abuts, inserts into or joins onto the secure housing 14 so that access to the secure halyard passageway 20 is only available from the interior of the secure housing 14. A halyard guide 18 is located at the upper end of the elongate conduit 12.

The arrangement shown in FIG. 1 additionally includes an upper housing 32 and a weight containment passageway 34. The halyard guide 18 is contained in the upper housing 32. An opening in the operatively lower end of the upper housing 32 provides access from the interior of the secure halyard passageway 20 to the interior of the upper housing 32. The elongate conduit 12 may abut, insert into or join onto the upper housing 32 so that access to the secure halyard passageway 20 is only available from the interior of the upper housing 32. The weight containment passageway 34 is a further internal passageway in the elongate conduit 12. An opening in the operatively lower end of the upper housing 32 provides access from the interior of the upper housing 32 to the weight containment passageway 34.

In the operative state, the banner raising apparatus 10 is mounted to a generally vertical support surface 22. The support surface 22 depicted in FIG. 1 consists of a solid pole. However the banner raising apparatus 10 can be mounted to a support surface 22 with virtually any characteristics. For example, the support surface 22 may be a wall, column or other suitable structure, may be formed from a wide range of substances, including timber, concrete, metal and plastic and may be hollow. Preferably the support surface 22 is located in a position where the banner raising apparatus 10 is prominently visible to the intended audience, for example, in a public place at a height such as on a telegraph pole adjacent to a busy road.

To raise a banner 38 using the banner raising apparatus 10, a halyard is used. A halyard 26 with two ends 28 and 30 is shown in FIG. 1 as a dashed line. The attached end 28 of the halyard 26 is located in the internal volume 24 of the secure housing 14. Travelling along the halyard 26, starting at the attached end 28, the halyard 26 passes through the halyard fastener 16. The halyard 26 then passes through the opening in the secure housing 14 into the secure halyard passageway 20. The halyard 26 travels up the secure halyard passageway 20 and passes through the opening in the upper housing 32 into the upper housing 32 and to the halyard guide 18. The halyard 26 then passes through the halyard guide 18 and, travelling through the opening in the upper housing 32, passes into the weight containment passageway 34. The halyard 26 travels down the weight containment passageway and terminates at the banner end 30. A weight 36 is attached to the banner end 30 of the halyard 26.

To raise a banner 38, the halyard 26 must first be lowered so that it can be accessed by a person on the ground level. The weight 36 acts under the influence of gravity to urge the banner end 30 of the halyard 26 in an operatively downward direction. The halyard guide 18 redirects the halyard 26 but preferably does not inhibit the movement of the halyard 26 or damage the halyard 26 when it moves. When the halyard 26 is attached to the halyard fastener 16, the movement of the halyard 26 under the influence of the weight 36 is restrained.

To lower the halyard 26, it must be released from the halyard fastener 16 by accessing the secure housing 14. Preferably the secure housing 14 is positioned to be within reach of a person at ground level. The security features of the secure housing 14 and the procedure for accessing and releasing the halyard fastener 16 is described in further detail with reference to FIG. 4 below. After releasing the halyard 26 from the halyard fastener 16, the weight 36 acts under the influence of gravity to pull the banner end 30 of the halyard 26 in a downward direction. The halyard guide 18 guides the movement of the halyard 26 so that the attached end 28 of the halyard 26 is drawn towards the secure halyard passageway. After the banner end 30 of the halyard 26 has been lowered, the attached end 28 of the halyard 26 is reattached to the halyard fastener 16 to retrain the halyard in the lowered position. Preferably the halyard 26 is of sufficient length to allow this to occur.

When the halyard 26 is in the lowered position, the banner 38 can be attached to the halyard 26 by a person at the ground level. Preferably the banner 38 is attached to the halyard 26 at two locations using a toggle and loop arrangement, hooks, carabiners or similar devices. In the depicted arrangement the banner 38 has a flexible rod 40 attached to the banner 38 in at least two locations in a tensioned or bent position so that as the rod 40 tends to return to the straightened position the banner 38 is tensioned and urged to an unfurled position. The rod 40 may be attached by insertion into pockets located in the banner 38. The rod 40 may be attached to the upper corner of the banner 38 furthest from the halyard 26 and the at a location along the edge of the banner 38 parallel and proximate to the halyard 26. An alternative arrangement for supporting the banner 38 with a swinging banner support arm is described with reference to FIGS. 13 and 16.

After attaching the banner 38, the banner 38 and halyard 26 are raised using the halyard raising apparatus 10. The attached end 28 of the halyard is again released from the halyard fastener 16. The operator then applies a force to the attached end 28 of the halyard 26 so that the halyard travels up the weight containment passageway 34 towards the halyard guide 18 and, after being guided by the halyard guide 18, the halyard 26 is drawn down the secure halyard passageway 20 towards the halyard fastener 16. The force applied should be sufficient to overcome the influence of gravity on the weight 36. The movement of the halyard 26 raises the banner 38.

When the banner 38 reaches the desired raised position, the halyard 26 is attached to the halyard fastener 16, thereby restraining the halyard 26 in the raised position. So that the banner 38 remains in the raised position, the halyard 26 is preferably a type which will not stretch under the influence of the weight 36 over time, for example a non-slump rope with a Kevlar core. When in the raised position, the banner 38 and the portion of the halyard 26 in the weight containment passageway 34 are located at the operatively upper end of the elongate conduit 12 at a height which preferably prevents access by a person on ground level. The portion of the halyard 26 in the secure halyard passageway 20 and in the secure housing 14 is surrounded by the secure halyard passageway 20 and the secure housing 14 respectively and cannot be accessed, except through secure housing 14. Consequently a person without security access to the secure housing 14, as described in more detail with reference to FIG. 4 below, cannot lower, tamper with, or steal the banner 38.

When the banner 38 is restrained in the raised position, movement of the edge of the banner parallel and proximate to the halyard 26 is restrained by tension in the halyard 26 caused by the influence of gravity on the weight 36, and the weight containment passageway 34 which prevents movement of the weight 36 except along that passageway. The weight 36 is preferably of sufficient mass to prevent appreciable movement of the edge of the banner parallel and proximate to the halyard 26. For example, a 5 kg weight would be sufficient for a 2000×900 mm banner. Preferably the banner has a limited rotational flexibility about the axis labelled 42 so that the banner 38 deflects under wind pressure, spilling the wind, and no significant force or bending moment resulting from wind pressure is applied to the banner raising apparatus 10 or the support surface 22.

Figure 2:
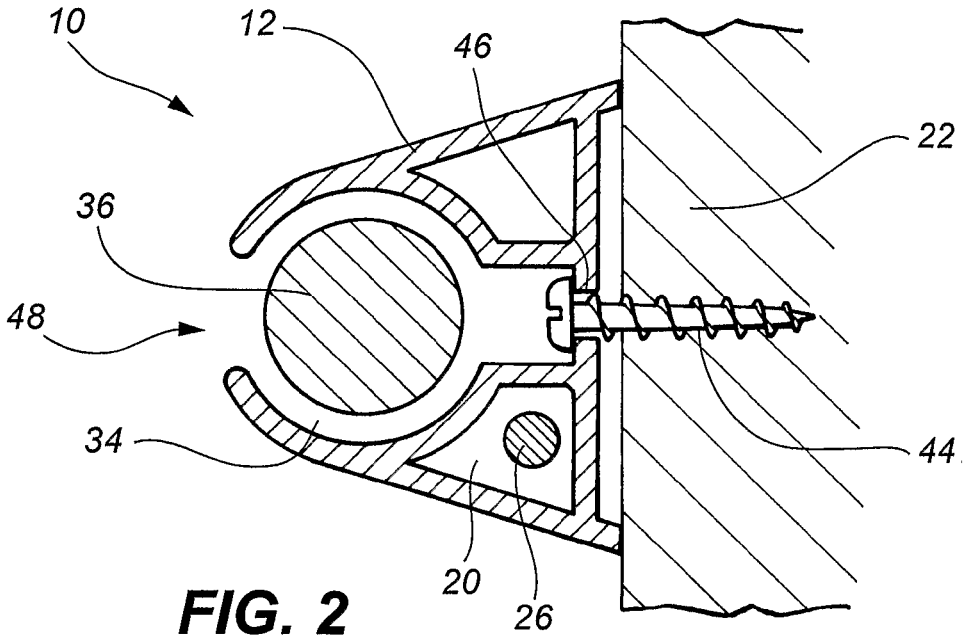
FIG. 2 shows a cross sectional view of the arrangement of FIG. 1.

FIG. 2 is a cross sectional view of a further arrangement in an operative state. FIG. 2 shows a cross sectional view of a halyard raising apparatus 10 having an elongate conduit 12, such as the elongate conduit 12 described with reference to FIG. 1. The elongate conduit 12 may be a metal extrusion, such as an aluminium extrusion, though any material which is difficult for an unauthorised person to penetrate would be suitable. Aluminium is particularly suitable if the banner raising apparatus 10 is to be exposed to weather due to its corrosion resistant properties. The elongate conduit 12 has a secure halyard passageway 20 and a weight containment passageway 34. The elongate conduit 12 has a longitudinal slot 48 along its length. The longitudinal slot 48 allows a banner to be attached to the portion of the halyard 26 which is located in the weight containment passageway 34. Spread apart, along the length of the elongate conduit 12, are holes 46 located in the wall of the elongate conduit 12 which is proximate to the support surface 22.

The banner raising apparatus 10 in FIG. 2 is shown mounted to a support surface 22 such as a wall. The elongate conduit 12 is mounted to the support surface 22 using fasteners 44, for example, screws, nails or other fastener known to be suitable. The body of each fastener 44 passes through the hole 46 and is secured in the support surface 22. The head of each fastener is pressed against the wall of the elongate conduit 12 proximate to the support surface 22, thereby fastening the elongate conduit 12 to the support surface 22. The slot 48 may be wide enough to allow the fasteners to be driven into place using a driving tool, such as a screw driver, drill or nail gun, whilst being narrow enough that access by an unauthorised person to the portion of the halyard in the weight containment passageway 34 is difficult or awkward. In one arrangement, a width of 10 to 15 mm has been found to be suitable.

The banner raising apparatus 10 is used with a halyard 26 and a weight 36, as is described in greater detail with reference to FIG. 1 above. A portion of the halyard 26 is shown in FIG. 2 located in the secure halyard passageway 20. This portion of the halyard is the portion of the halyard which travels from a halyard fastener (not shown) to a halyard guide (not shown). It is not possible for a person to access this portion of the halyard from the exterior of the elongate conduit 12.

After passing though the halyard guide, the halyard travels down the weight containment passageway 34 and terminates in the weight 36. Though the slot 48 provides limited access to the weight containment passageway 34, when a banner is in the raised position, the weight 36 and the portion of the halyard 26 in the weight containment passageway 34 is located at the operatively upper end of the elongate passageway 12 and preferably cannot be accessed by a person from the ground level.

As is described in greater detail with reference to FIG. 1, the halyard 26 may be raised or lowered using the halyard raising apparatus 10. When the halyard 26 is raised or lowered, the halyard 26 travels in one direction along the secure halyard passageway 20 whilst, due to the halyard guide redirecting the halyard 26, the weight travels in an opposite direction along the weight containment passageway 34. By using two separate passageways, the lengths of the halyard 26 travelling in opposition directions do not interfere with each other and cannot become tangled or wear against each other.

Figure 3:
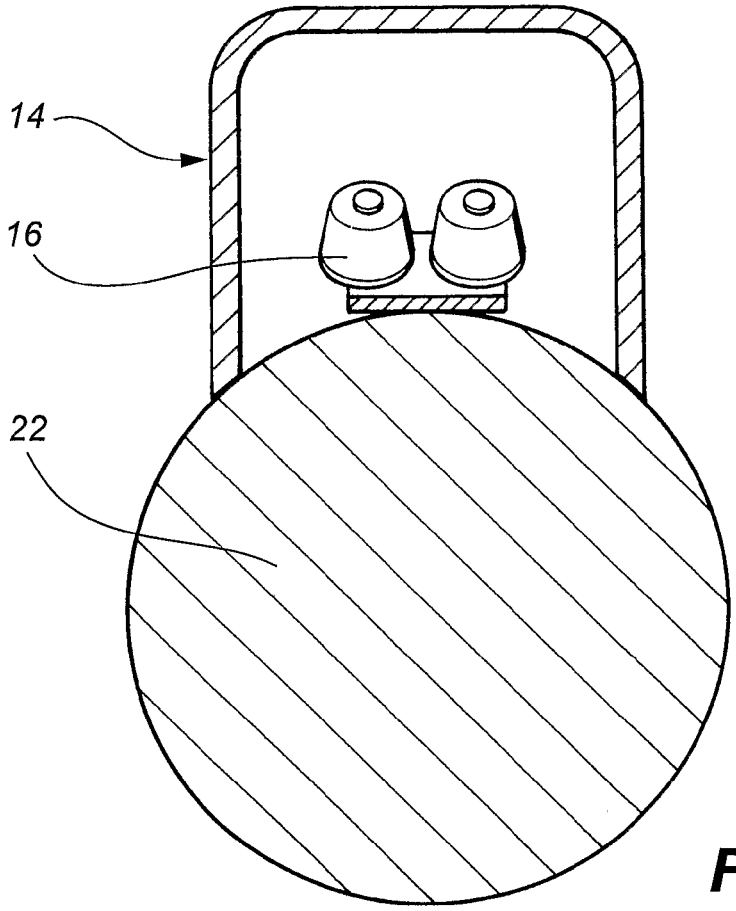
FIG. 3 shows a cross sectional view of the secure housing shown in FIG. 1, sectioned along the plane 3-3 indicated in FIG. 1.

FIG. 3 is a cross sectional view of the secure housing 14 shown in FIG. 1, sectioned along the plane 3-3 indicated in FIG. 1. The secure housing 14 is shown mounted to a curved support surface 22. The edges of the secure housing 14 extend to the perimeter of the support surface 22 so that access to the halyard fastener 16 is prevented from the exterior of the secure housing 14. The edges of the secure housing 14 which extend in the operatively upwards direction may be bevelled so as to abut the curved support surface 22 without a gap or may embed into the support surface 22. In either case there is no gap for unauthorised access or for a person to insert a crowbar to forcibly remove the secure housing 14.

Figure 4:
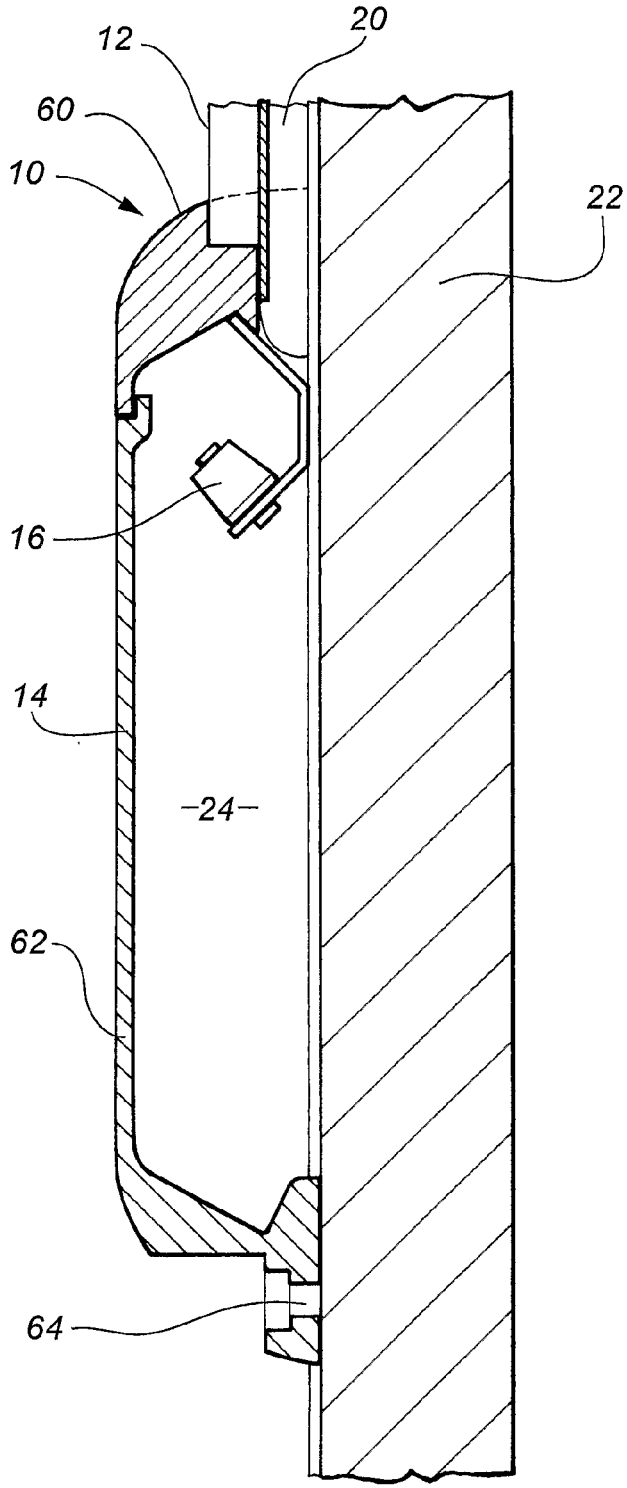
FIG. 4 shows a more detailed cross sectional side view of an embodiment of the secure housing depicted in FIG. 1.

FIG. 4 shows a more detailed cross sectional view of the secure housing 14 depicted in FIG. 1. The secure housing 14 has an upper part 60 and an lower part 62. The secure housing may be formed from metal or a metal alloy, such as by casting aluminium, though any material which is difficult for an unauthorised person to penetrate would be suitable. Aluminium is particularly suitable if the banner raising apparatus 10 is to be exposed to weather due to its corrosion resistant properties. Preferably the internal volume 24 of the secure housing 14 is of sufficient capacity to contain the length of the halyard 26 between the halyard fastener 16 and the attached end 28 of the halyard 26 when the halyard is in the raised position.

The halyard fastener 16 may be attached to the upper part 60 of the secure housing 14 or may be attached to the support surface 22. Any known attaching means such as fasteners or welding may be used. The halyard fastener 16 may be any device which is capable of releasably attaching the halyard and preferably, is capable of reliably restraining the halyard without slipping or malfunctioning. A cam cleat has been found to be suitable for use as the halyard fastener 16.

The operatively upper part 60 has an opening shaped to couple with the elongate conduit 12 so that a halyard (not shown) can pass from the secure halyard passageway 20 in the elongate conduit to the interior of the secure housing 14. The coupling of the elongate conduit 12 to the secure housing 14 is preferably such that the secure halyard passageway 20 cannot be accessed, except from the interior of the secure housing 14.

Preferably the secure housing 14 prevents an unauthorised person from releasing the halyard, accessing the halyard contained in the secure housing 14 or accessing the halyard fastener 16. With reference to FIG. 4, the lower part 62 and the upper part 60 of the secure housing 14 are mounted to the support surface 22 and couple together, when mounted, to prevent access from the exterior of the secure housing 14.

The upper part 60 of the secure housing 14 may be mounted to the support surface 22 or may be mounted to the elongate conduit 12 which is mounted to the support surface 22. In either case it is preferable that the upper part 60 cannot be removed without removing the lower part 62 or the elongate conduit 12. The lower part 62 of the secure housing 14 may be mounted to the support surface 22 using fasteners (not shown) which pass through the holes 64 and penetrate into the support surface 22. To prevent an unauthorised person from removing the lower part 62, the fasteners may be friction driven screws. Friction driven screws require a particular tool for removal. Such tools are not readily available. Consequently, an unauthorised person is unlikely to be able to remove the fasteners, remove the lower part of the secure housing 62 and release the halyard.

Many alternative embodiments of the secure housing are possible. For instance, the housing could be a single part which is attached to the support surface using friction driven screws. Alternatively, the secure housing may have an access hatch which is locked and can be opened using a security key. As a further alternative, the secure housing may contain a winch mechanism which operates to retract or deploy the halyard. In this example, it may not be necessary to access the interior of the secure housing, the winch mechanism instead being activated from the exterior of the secure housing a security device, for instance, a security handle which is received by a receptacle on the exterior of the secure housing. Alternatively the winch mechanism could be motorised and activates in response to a security signal, such as a code.

Figure 5:
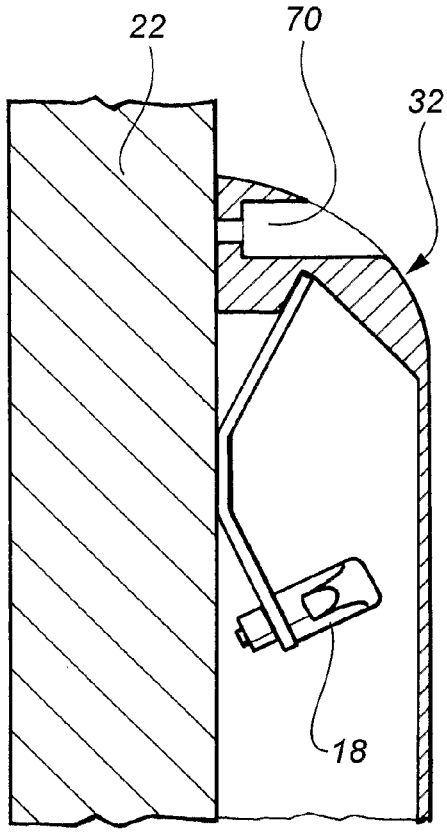
FIG. 5 shows a more detailed cross sectional side view of an embodiment of the upper housing depicted in FIG. 1.

FIG. 5 shows a more detailed cross sectional view of a portion of the upper housing 32 depicted in FIG. 1. Preferably the upper housing 32 is formed from a water-proof material so that moisture cannot penetrate into the secure halyard passageway and pool in the secure housing. Typically the upper housing 32 is located at a height such that access by an unauthorised person is difficult without the use of a lifting device and consequently the upper housing 32 does not typically need to resist penetration by an unauthorised person. If additional security is desired or if the upper housing can be easily accessed by an unauthorised person, the upper housing may be formed from metal or a metal alloy, such as by casting aluminium, though any material which is difficult for an unauthorised person to penetrate would be suitable. Aluminium is particularly suitable if the banner raising apparatus 10 is to be exposed to weather due to its corrosion resistant properties.

The upper housing 32 is shown in the operative state, mounted to the support surface 22. The upper housing 32 is mounted directly to the support surface 22 using fasteners located in holes 70. If additional security is desired, the fasteners may be friction driven screws so that unauthorised removal is inhibited as described in more detail with reference to FIG. 4. If the upper housing 32 is located at a height which inhibits unauthorised access, normal fasteners may be used. The upper housing 32 may be mounted to the support surface 22 using any other known mounting means. Alternatively, the upper housing 32 may be mounted to the elongated conduit (not shown) which is mounted to the support surface as described above.

The halyard guide 18 is contained in the upper housing 32. The halyard guide 18 is shown in FIG. 5 mounted to the upper housing 32. The mounting may be accomplished by welding, fasteners or other known means. Alternatively, the halyard guide 18 may be mounted directly to the support surface 22 using conventional means, such as fasteners. The halyard guide 18 guides the halyard (not shown) from the secure halyard passageway to the weight containment passageway. The halyard guide 18 is preferably a device which guides the halyard so that its movement is not restricted and does not cause damage to it. A fairlead is suitable for use as a halyard guide 18, as are similar devices such as a pulley.

Figure 6:
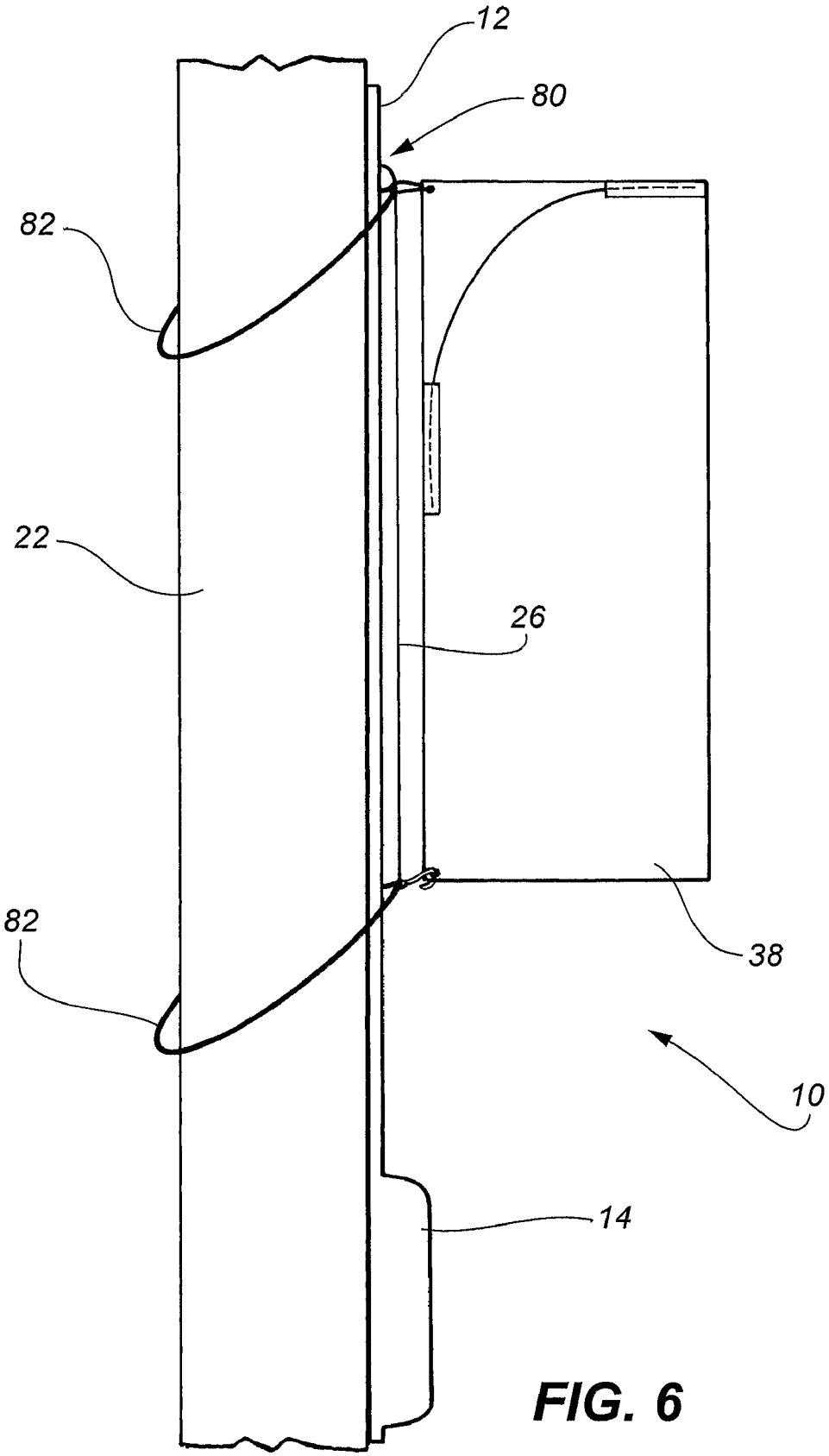
FIG. 6 shows a side view of an arrangement using weighted loops passing around a pole.

FIG. 6 shows a side view of a further arrangement which does not have the upper housing and the weight containment passageway. Referring to FIG. 6, a banner raising apparatus 10 is depicted in the operative state. The banner raising apparatus 10 has an elongate channel 12 which when mounted forms a secure halyard passageway. Located at the lower end of the elongate conduit is a secure housing 14 which contains a halyard fastener (not shown). An opening in the operatively upper end of the secure housing 14 provides internal access from the interior of the secure housing 14 to the interior of the secure halyard passageway. Preferably the elongate channel 12 abuts, inserts into or joins onto the secure housing 14 so that access to the secure halyard passageway is only available from the interior of the secure housing 14.

The upper end of the elongate channel 12 is closed to prevent ingress by water or access by an unauthorised person. An opening 80 in the elongate channel 12 at its upper end allows a halyard 26, when installed, to exit the secure halyard passageway. A halyard guide (not shown) is located at the opening and may comprise a smooth, saddle shaped surface which is capable of guiding the halyard 26 so that its movement is not restricted and does not result in damage.

The banner raising apparatus 10 in FIG. 6 is shown mounted to a support surface 22 such as a pole. The banner raising apparatus 10 is being used in conjunction with a halyard 26 and a banner 38 which are shown in the raised position. A weighted loop 82 is attached to each of the upper and lower corners of the banner 38 proximate to the halyard 26. The weighted loops 82 circumnavigate the support surface 22 and may comprise lead weighted ropes. Movement of the upper and lower corners of the banner 38 proximate to the halyard 26, for instance under the influence of wind, is restrained by the weighted loops 82. The weighted loops 82, as a result of gravity, additionally tension the halyard 26 and inhibit movement of the upper and lower corners of the banner 38 proximate to the halyard 26 in an upwards direction parallel to the support surface 22. However, the weighted loops 82 are capable of moving up and down the support surface 22 when the banner 38 is raised or lowered by operation of the halyard 26.

The arrangements described herein with reference to FIGS. 1 to 6 can be mounted to a wide variety of different structures which have a support surface. These support surfaces are thereby converted to a secure banner raising apparatus. Possible arrangements of the banner raising apparatus when mounted to the support surface are shown in the accompanying drawings. Further, methods for attaching the banner raising apparatus to the support surface are described with reference to FIGS. 1 to 5 above.

To operate the banner raising apparatus, a halyard is installed. The halyard is threaded through the apparatus so as to be arranged as is described with reference to FIG. 1 or 6. The halyard can be installed prior to mounting the banner raising apparatus to the support surface. Alternatively the halyard can be installed after mounting the banner raising apparatus by feeding the attached end of the halyard down the secure halyard passageway from the upper opening, assisted by gravity. The banner end of the halyard is then fed down the weight containment passageway, also assisted by gravity. After mounting the banner raising apparatus to the support surface, a halyard is provided and installed in the banner raising apparatus. The banner end of the halyard is adapted to connect to a banner, for instance by a toggle and loop arrangement, a carabiner or the like.

Arrangements Using Internal Cavity of Supporting Pole

Figure 7:
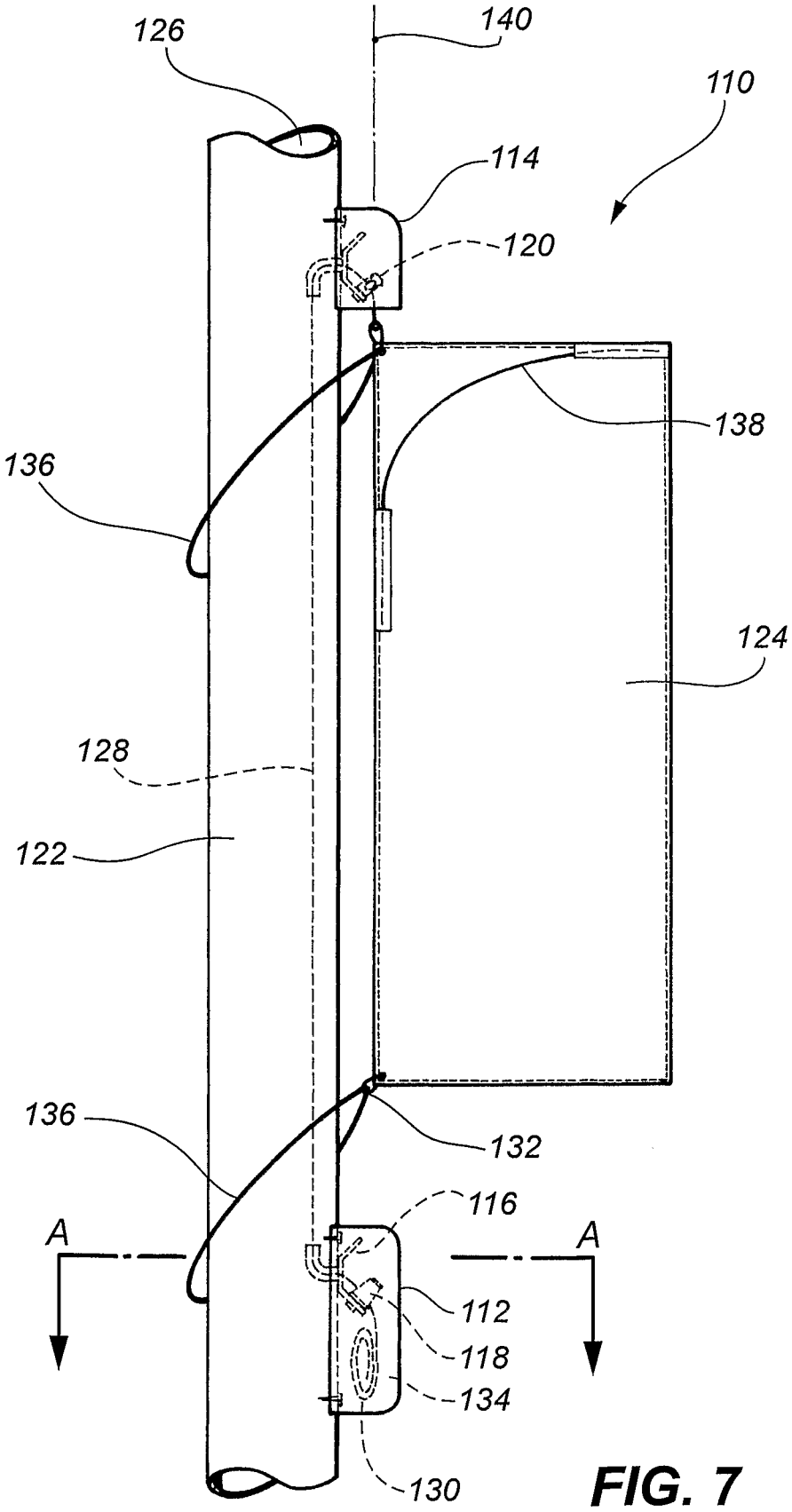
FIG. 7 is a side view of a second arrangement in which a halyard system uses an internal cavity of a supporting pole.

FIG. 7 of the accompanying drawings shows an arrangement in which the halyard passes through an internal cavity of a supporting pole. The internal halyard system 110 shown consists of a lower housing 112 and an upper housing 114. The lower housing contains a lower halyard guide 116 and a releasable halyard fastener 118. The lower housing is discussed in greater detail with reference to FIGS. 8 and 9 below. The upper housing contains an upper halyard guide 120 and is discussed in greater detail with reference to FIG. 10 below.

The internal halyard system 110 is depicted in FIG. 7 installed on a pole 122 with a tubular cross section. The internal halyard system 110 may be used with poles of a different cross sectional shape or with similar structures such as columns or the like. The pole 122 must be capable of supporting the weight of the internal halyard system 110 when installed. It is an advantage if the pole 122 is located in a prominent position and extends generally vertically to a height so that a banner 124 raised on the pole 122 is prominently displayed to its intended audience. Existing metal light or electricity poles or existing banner poles in frequently visited public areas have been found to be suitable.

The pole 122 has a secure internal cavity 126 which extends vertically from the height of the lower housing to at least the height at which the banner is to be displayed. Preferably the internal cavity 126 cannot readily be accessed by a person at ground level. The internal cavity 126 must be suitable for a halyard to travel through. Thus, for some poles which house electrical wires, for example, the halyard system described may not be suitable.

As shown in FIG. 7, a halyard 128 is used with the internal halyard system 110. The halyard 128 has two ends, an attached or lower end 130 and a upper end 132. The lower end 130 of the halyard 128 is located in the internal volume 134 of the lower housing 112. Travelling along the halyard 128, from the lower end 130 to the upper end 132, the halyard 128 passes through the halyard fastener 118 and into the lower halyard guide 116. The lower halyard guide 116 directs the halyard 128 into the inner cavity 126 through the sidewall of the pole 122, vertically up the inner cavity 126 and to the upper halyard guide 120. The upper halyard guide 120 directs the halyard 128 to exit the inner cavity 126 though the sidewall of the pole 122 and travel in a downwards direction. The halyard 128 exits the upper housing 114 through a lower opening in the upper housing and travels downward proximate to the pole 122. Attached to the upper end 132 of the halyard 128 is a banner 124 and weighted loops 136.

Figure 8:
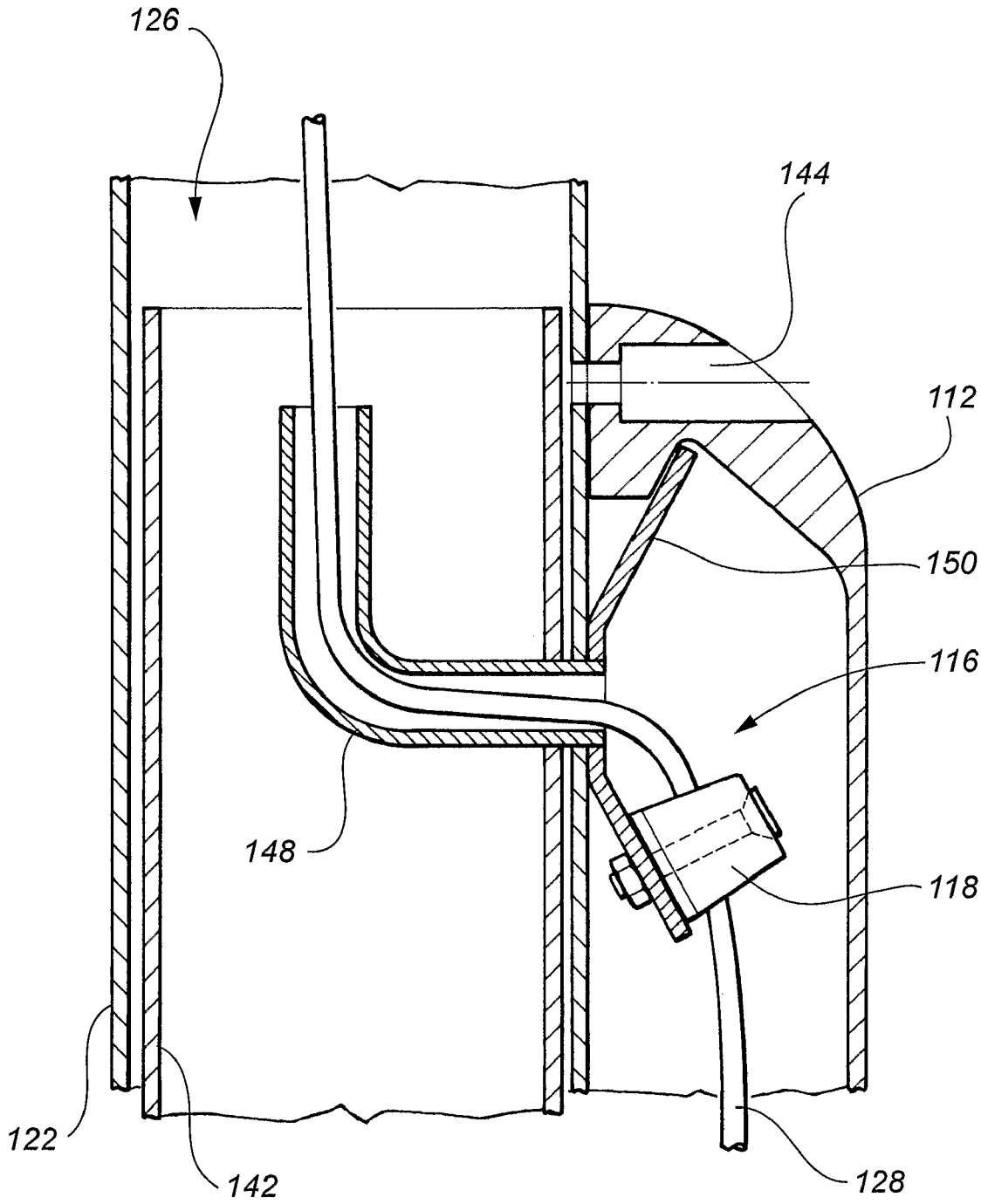
FIG. 8 is a cross sectional side detail of the lower housing in the arrangement of FIG. 8.

FIG. 8 shows a more detailed cross sectional view of the lower housing 112. The lower housing 112 may be formed from metal or metal alloy, such as by casting, though any material which is difficult for an unauthorised person to penetrate would be suitable. If the lower housing 112 is likely to be exposed to weather, the lower housing 112 is preferably constructed from a weather resistant material, such as aluminium, or is provided with a protective coating, such as galvanising or painting.

The lower housing 112 contains the lower halyard guide 116, the halyard fastener 118 and, when a halyard is used, the portion of the halyard between the halyard fastener and the lower end 130. The lower housing 112 restricts an unauthorised person from accessing its contents. When mounted, the lower housing forms an internal compartment which cannot be accessed from the exterior by an unauthorised person. Since the halyard 128 passed from the lower housing 112 into the internal cavity 126, the lower housing prevents an unauthorised person obtaining access to the halyard 128 or the halyard fastener 118 from the ground level.

The lower housing 112 is mounted to the pole 122 using mechanical fasteners which pass through the hole 144 and into the pole 122. Screws or similar fasteners may be used. Alternatively the lower housing 112 may be attached to the pole 122 using any other known attachment means, for instance welding or gluing. If mechanical fasteners are used, to prevent an unauthorised person from removing the lower housing 112, friction driven screws may be used. Friction driven screws require a particular tool to remove which is not readily available. The lower housing may alternatively be mounted to the ground or other structure so that it abuts the pole 122.

The lower housing 112 may be removed by unscrewing the friction driven screw using an appropriate tool. Removing the lower housing 112 allows a person to access the halyard fastener 118 and the halyard 128 for the purposes of raising and lowering the halyard 128.

Many alternate embodiments of the lower housing are possible. For instance, the housing may have an upper part and a lower part which are attached to the support surface using friction driven screws. To access the lower housing, the lower part is removed. Alternatively, the lower housing may have an access hatch which is locked and can be opened using a security key. As a further alternative, the lower housing may contain a winch mechanism which operates to retract or deploy the halyard. In this example, it may not be necessary to access the interior of the lower housing, the winch mechanism instead being activated from the exterior of the lower housing a security device, for instance, a crank with a security fitting which is received by a receptacle on the exterior of the lower housing. Alternatively the winch mechanism could be motorised and activates in response to a security signal, such as a code.

Figure 9:
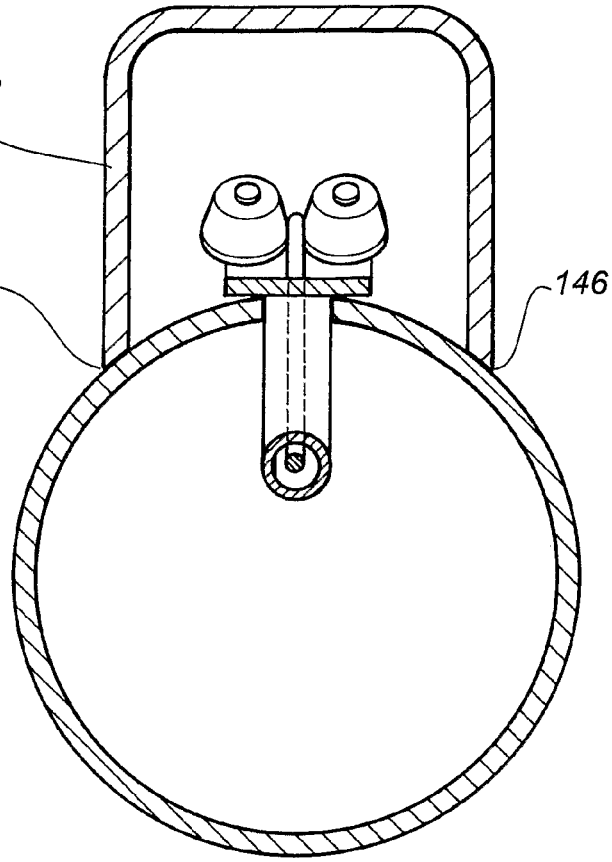
FIG. 9 is a cross sectional top view of the lower housing sectioned though plane A-A indicated on FIG. 7.

FIG. 9 is a cross sectional view of the lower housing shown in FIG. 7, sectioned along the A-A section indicated in FIG. 7. The lower housing 112 is shown mounted to the curved surface of the pole 122. The edges of the lower housing 112 extend to the perimeter of the pole 122 so that access to the halyard fastener 118 and the halyard 128 is prevented from the exterior of the lower housing 112. The edges 146 of the lower housing are bevelled so as to abut the pole 122 without a gap. Alternatively the edges 146 may embed into the pole 122. In either case there is no gap for unauthorised access or a person to insert a lever or crowbar to forcibly remove the lower housing 112.

Figure 10:
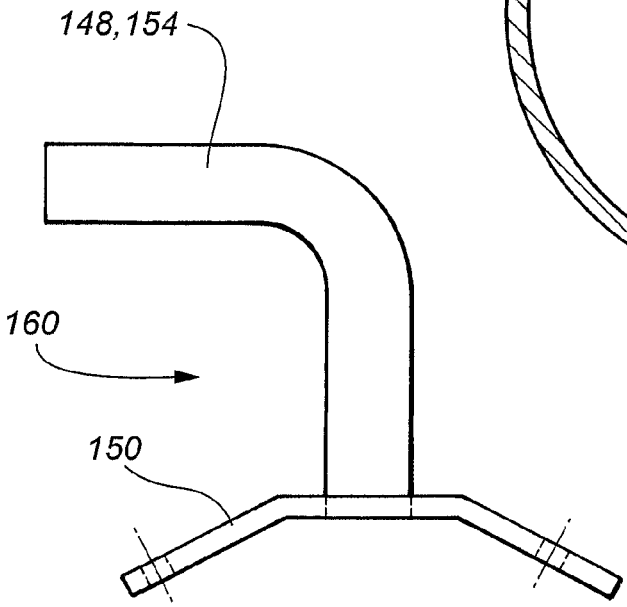
FIG. 10 is a front view of a part forming a portion of the upper halyard guide and the lower halyard guide.
Figure 11:
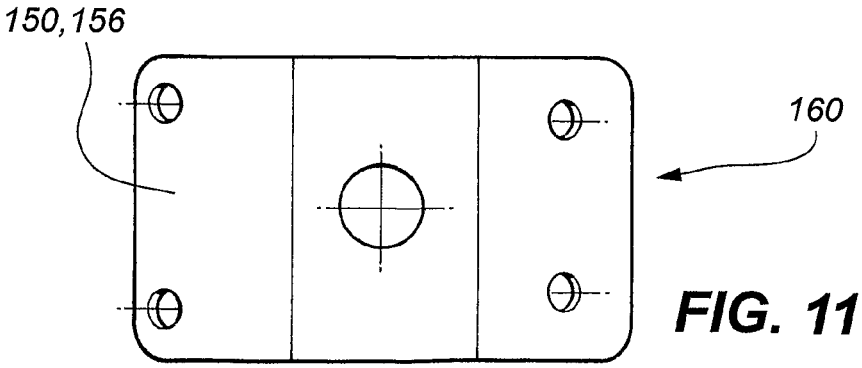
FIG. 11 is a top view of the part forming a portion of the upper halyard guide and the lower halyard guide.
Figure 12:
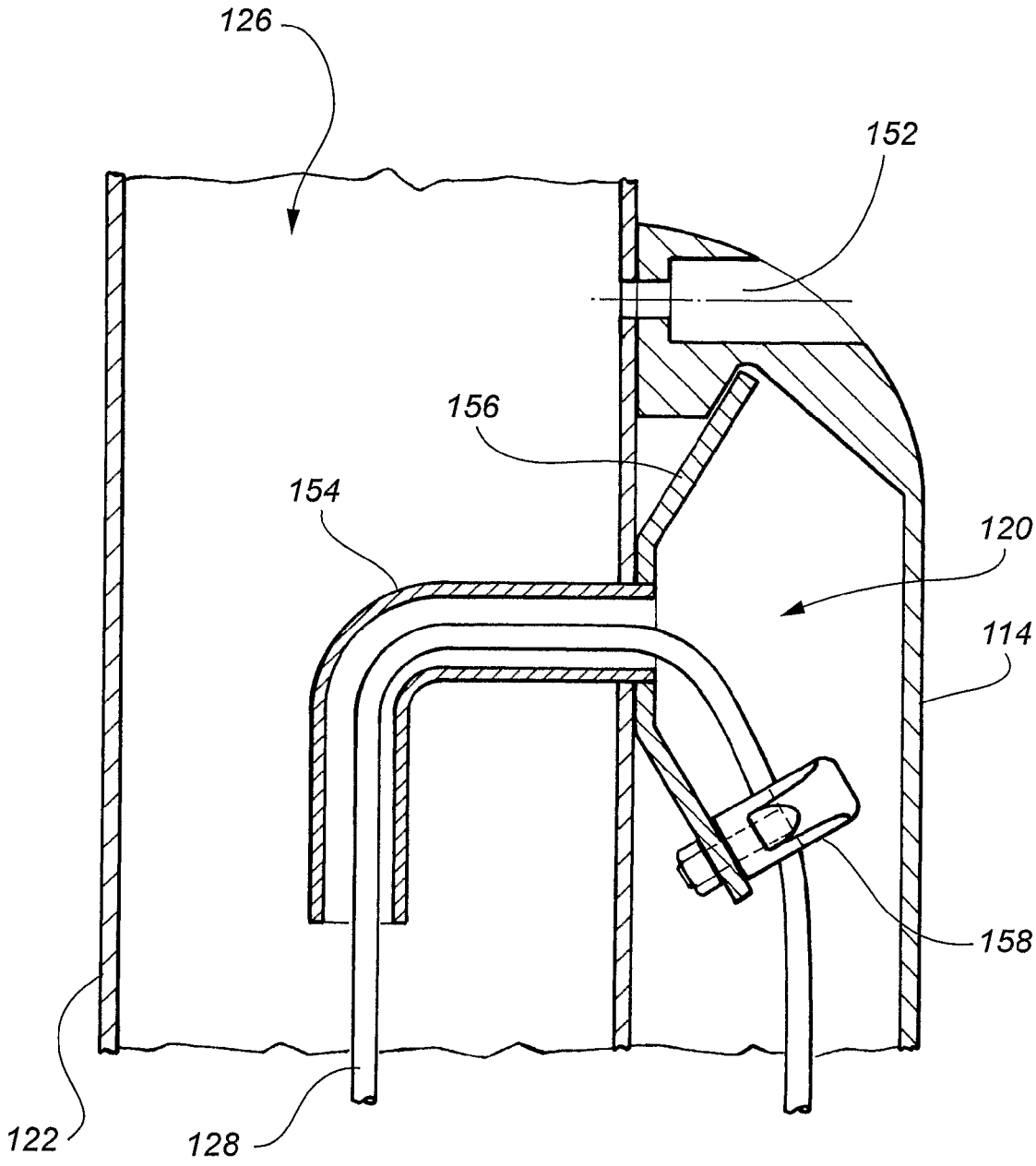
FIG. 12 is a cross sectional side detail of the upper housing.

Referring to FIGS. 10, 11 and 12, the lower halyard guide 116 has a tubular elbow 148 which is attached to a plate 150. The tubular elbow 148 and the plate 150 may alternatively be integrally formed. The tubular elbow 148 passes through a hole in the pole 122. Preferably, the tubular elbow 148 passes through a hole in the pole 122 and a hole in a spigot 142. The spigot 142 is located inside the lower portion of the pole 122 and provides structural support to the pole 122. Consequently the wall of the pole 122 adjacent to the spigot 142 is structurally reinforced by the spigot 142 and the creation of a hole does not significantly weaken the pole 122. The plate 150 may be mounted to the lower housing 112 or the pole 122.

Since only the tubular elbow 148 of the lower halyard guide 116 passes through the hole in the pole 122, the hole may be a diameter equal to the outer diameter of the tubular elbow 148. A smaller hole is advantageous because the pole 122 is not weakened. A suitable outer diameter of the tubular elbow 148 is 12 mm and consequently a hole with a diameter of 13 mm is suitable. A hole this size does not noticeably weaken the pole 122.

The halyard 128 passes through the tubular elbow 148. Preferably the tubular elbow 148 has a sufficient inner diameter to allow the halyard 128 to move freely. The inside walls of the tubular elbow 148 are smooth and the elbow curvature has radius such that movement of the halyard 128 is not restricted and does not cause damage to the halyard 128.

A number of alternate devices may be used instead of the tubular elbow 148. For example, an elbow with a half pipe cross section may be used. Alternatively, a small pulley wheel may be attached to the end of a bar. The bar with pulley attached is then inserted through the hole. The hole has a diameter such that the halyard can pass through the hole adjacent to the bar.

The halyard fastener 118 is mounted to the plate 150 using a fastener, though any known method of attachment may be used and the halyard fastener 118 may be mounted to other components such as the lower housing 112. The halyard fastener is a cam cleat. Any similar device, to which the halyard 128 may be releasably attached, such as a cleat or hook, may be used. Preferably the halyard fastener 118 securely restrains the halyard 128 and does not allow the halyard 128 to slip over time.

FIG. 12 shows a more detailed cross sectional view of the upper housing 120. Preferably the upper housing 114 is formed from a water-proof material so that moisture cannot penetrate into the inner cavity 126. Typically the upper housing 120 is located at a height such that access by an unauthorised person is difficult without the use of a lifting device. Consequently the upper housing 120 does not typically need to resist penetration by an unauthorised person. If additional security is desired or if the upper housing can readily be accessed by an unauthorised person, the upper housing may be formed from metal or a metal alloy, though any material which is difficult to penetrate would be suitable. If the upper housing 120 is exposed to weather, it is advantageous if it is formed from a weather resistant material, such as aluminium, or has a protective coating, such as galvanising or painting.

The upper housing 120 contains the upper halyard guide 120 and has a bottom opening which allows the halyard 128 to pass through. The upper housing 114 is mounted to the pole 122 using mechanical fasteners which pass through the holes 52. Other known attachment means, such as welding or gluing, may be used. If additional security is desired, the upper housing 114 may be mounted using friction driven screws. Friction driven screws require a particular tool to remove which is not readily available and so prevent unauthorised people removing the upper housing 114.

Referring to FIGS. 10, 11 and 12, the upper halyard guide 120 has a similar construction to the lower halyard guide 118. The upper halyard guide 120 has a tubular elbow 154 attached to a plate 156. The tubular elbow 154 passes through a hole in the pole 122. Since only the tubular elbow 154 passes through the hole in the pole 122, the hole may be a diameter equal to the outer diameter of the tubular elbow 154. A suitable outer diameter of the tubular elbow 154 is 12 mm and consequently a hole with a diameter of 13 mm is suitable. A hole this size located in the upper portion of the pole does not noticeably weaken the pole 122. The plate 156 may be attached to the pole 122 or the upper housing 114.

The halyard 128 passes through the tubular elbow 154. Preferably the tubular elbow 154 has a sufficient inner diameter to allow the halyard 128 to move freely. The inside walls of the tubular elbow 154 are smooth and the elbow curvature has radius such that movement of the halyard 128 is not restricted and does not cause damage to the halyard 128. The upper halyard guide 120 has a fairlead 158 which guides the halyard 128 in a downward direction after it has exited the inner cavity 126. Similar devices, such as pulleys, which do not restrict the movement of the halyard or damage the halyard may be used. The fairlead is attached to the plate 156 using mechanical fasteners, though other attaching means, such as welding, are suitable.

The lower halyard guide 118 shown in FIG. 8 and the upper halyard guide 120 shown in FIG. 12 are constructed from the part 160 shown in FIGS. 10 and 5. In the case of the lower halyard guide 118, a halyard fastener 116 is attached, whilst in the case of the upper halyard guide 120, a fairlead 158 is attached. The use of the same part 160 reduces the number of different parts to be manufactured.

The internal halyard system 110 does not require an upper housing. Since the halyard 128 exits the inner cavity 126 at a height, it cannot usually be accessed without the use of a lifting device. This will normally prevent unauthorised people accessing the halyard 128. Further, the halyard 128 does not need to exit the internal cavity 126 through the sidewall of the pole 122. The halyard 128 may alternatively exit from the top of the pole 122. In this case the upper housing and the upper halyard guide would be located at the top of the pole. The upper halyard guide could be a pulley wheel or smoothed lip located at the top of the pole 122. An upper halyard guide which is free to rotate about the pole may be used to prevent the banner being wrapped around the pole under the influence of wind.

Referring again to FIG. 7, the process for raising a banner 124 will now be explained. To raise the banner 124, the halyard 128 must first be lowered to allow access by a person at ground level. The weighted loops 136 act under the influence of gravity to urge the upper end 132 of the halyard 128 in a downward direction. The upper halyard guide 120 and lower halyard guide 116 guide the halyard but do not inhibit its movement. When the halyard 128 is attached to the halyard fastener 118, the movement of the halyard under the influence of the weighted loops 136 is restrained.

To lower the halyard 128, it must be released from the halyard fastener 118 by accessing the lower housing 112. Preferably the lower housing 112 is positioned to be within reach of a person at ground level. After releasing the halyard 128 from the halyard fastener 118, the weighted loops 136 act under the influence of gravity to pull the upper end 132 of the halyard 128 in a downward direction. This causes the lower end 130 of the halyard 128 to be drawn towards the inner cavity 126. After the upper end 132 has been lowered the lower end 130 is reattached to the halyard fastener 118 to restrain the halyard in the lowered position. Preferably the halyard 128 is of sufficient length for this to occur.

When the halyard 128 is in the lowered position, the banner 124 is attached to the halyard by a person at ground level. Preferably the banner 124 is attached to the halyard 26 in at least one location using hooks and eyelets, a toggle and loop arrangement, carabiners or similar devices. A flexible rod 138 may be attached to the banner 124. The rod 138 is attached in at least two locations in a tensioned or bent position so that as the rod 138 tends to return to the straightened position, the banner 124 is tensioned and urged to an unfurled position. The rod 138 may be attached to the upper corner of the banner 124 furthered from the halyard 128 and at a location along the edge of the banner 124 parallel and proximate to the halyard 128.

After attaching the banner 124, the banner 124 and halyard 128 are raised. This is accomplished by releasing the halyard 128 from the halyard fastener 118. An operator then applies a force to the lower end 130 of the halyard 128 in a direction away from the lower halyard guide 116, causing the halyard to travel down the inner cavity 126 and the upper end 132 of the halyard 128 to travel upwards towards the upper halyard guide 120. The force applied should be sufficient to overcome the influence of gravity on the weighted loops 136.

When the banner 124 reaches the desired raised position, the halyard 128 is attached to the halyard fastener 118, thereby restraining the halyard 128 in the raised position. So that the banner 124 remains in the raised position, the halyard 128 is preferably a type which will not stretch under the influence of the weighted loops 136 over time. For example, the halyard could be non-slump rope with a Kevlar core. In the raised position, the banner 124, halyard 128 and weighted loops 136 are preferably raised to a height which prevents access by a person at ground level. Since the halyard 128 travels through the inner cavity 126, through the lower halyard guide 116 and into the lower housing 112, the halyard 128 cannot be accessed, raised, lowered or otherwise tampered with except by accessing the lower housing 112. The length of the halyard 128 between the lower end 130 and the halyard fastener 118 is stored in the lower housing 112, which has a sufficient internal volume 134 for this purpose.

When the banner 124 is restrained in the raised position, movement of the edge of the banner parallel and proximate to the halyard 128 is restrained by tension in the halyard caused by the lower weighted loop 136. The weighted loops 136 pass around the pole 122 and prevent the upper and lower corners of the banner 124 proximate to the halyard 128 from moving away from the pole 122. The weighted loops allow the banner 124 rotational flexibility about the axis labelled 140 so that the banner 124 deflects under wind loading, spilling wind, and no significant resultant load is applied to the upper housing 20 or the pole 122. Many different arrangements may be used instead of the weighted loops 136. For instance, non-weighted loops may be used and a weight hung from the banner. Alternatively a weight may be attached to the lower end of the banner and restrained in a channel attached to the pole.

With reference to FIGS. 7 to 12, the internal halyard system 110 may be installed on a pole 122 using the following process. Firstly, upper and lower holes are created in the pole. The holes are easily bored using a drill or similar device. Non-circular holes may be created, though circular holes are easier and are therefore preferable. The lower hole may pass through the pole 122 and the spigot 142. The tubular elbow 154 of the upper halyard guide 120 is inserted into the upper hole so that the plate 156 abuts the pole 122 and is fixed in place.

The halyard 128 is then threaded through the upper halyard guide 120 and into the internal cavity 126. The halyard 128 is fed down the internal cavity 126 under the influence of gravity. The halyard 128 is hooked, by inserting a hook through the lower hole, and drawn through the lower hole. The halyard 128 is threaded through the lower halyard guide 116. The tubular elbow 148 of the lower halyard guide 116 is then inserted into the lower hole so that the plate 150 abuts the pole 122 and is fixed in place. The halyard fastener 118 is attached to the plate 150 of the lower halyard guide 116. The lower housing and the upper housing are then mounted to the pole 122 using friction drive screws through holes 144 and 52 respectively.

Arrangements Using a Swinging Banner Support Arm

Figure 13:
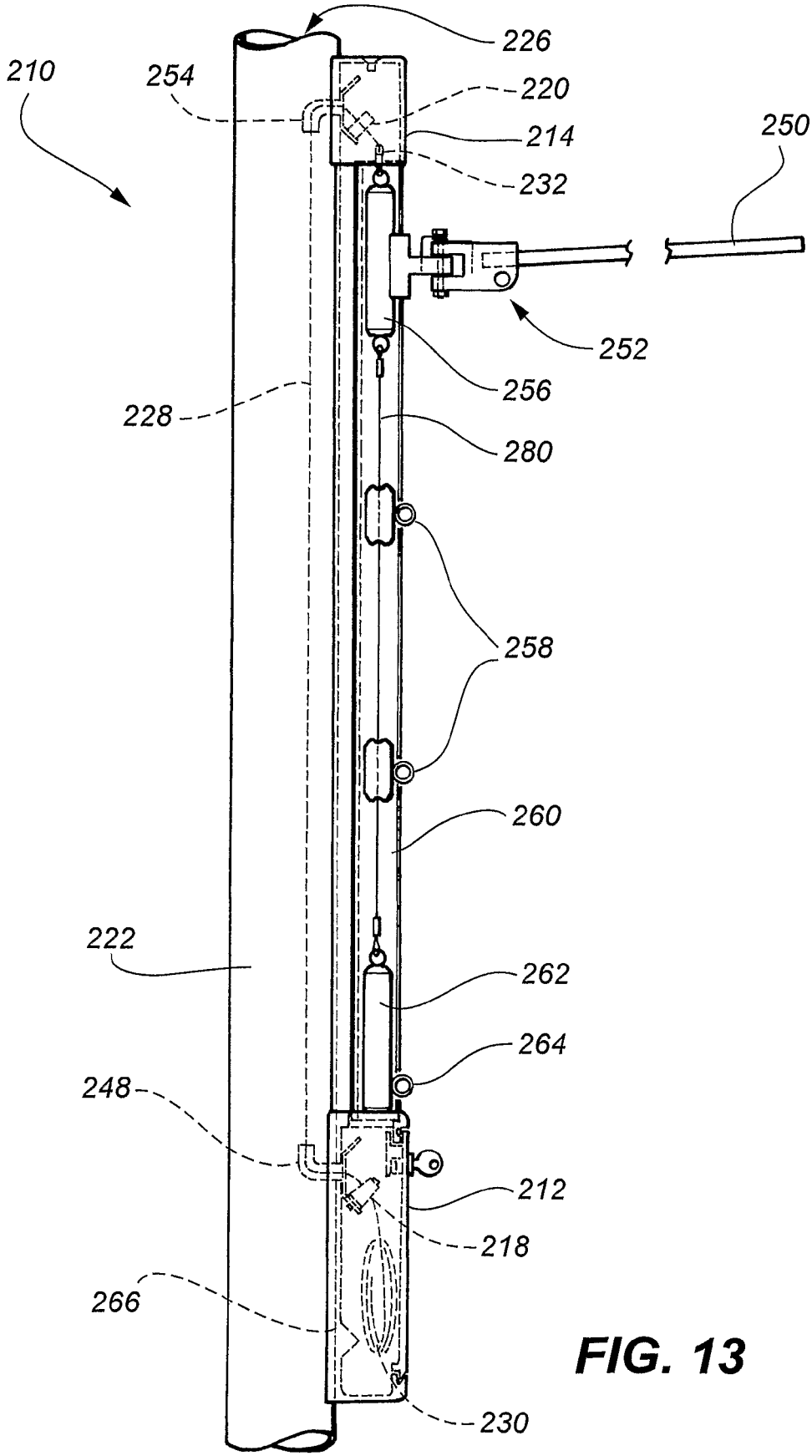
FIG. 13 is a side elevation view of a third arrangement in which banner support system includes a swinging banner support arm.

In the arrangements depicted in FIGS. 1 and 7, a flexible rod 40, 138 is used to support the banner 38, 124. An alternative arrangement for supporting the banner is shown in FIG. 13. An elongate member or batten 250 is inserted into a banner support arm 252 that in turn is attached to a weight 256 by means of a gooseneck arrangement described in more detail with reference to FIG. 14C. The weight 256, gooseneck and banner support arm 252 form a pivoting attachment for the elongate member or batten 250. Weight 256 may move within a conduit 260 defined within the banner support system 210. The conduit 260 extends downwards from the upper housing 214 towards the lower housing 212. The conduit 260 is preferably long enough to match a vertical length of the banners to be supported by the banner support system 210. Conduit 260 may be referred to as a banner-support conduit.

Weight 256 is connected to another weight 262 by cord 280. The cord 280 may be formed of the same material as halyard 228. The cord 280 and weight 262 are also positioned in conduit 260. In one arrangement, weights 256, 262 are made of stainless steel. Two or more glides 258 are positioned at intervals along the cord 280. The glides may be formed of an acetal-based plastic. Each of the glides 258 has an eyelet attached. An eyelet 264 is also attached to or formed on weight 262. The length of the cord 260 may correspond to the vertical length of the banners to be supported by the banner support arm 252.

In use, the batten 250 is approximately orthogonal to the cord 280. The batten 250 may be inserted into a pocket in an operatively upper edge of the banner to be supported. A side edge of the banner may be connected to each of the eyelets on the glides 258 and the eyelet on 264 on weight 262. Snap hooks on the banner may be used to connect the banner to the eyelets. Thus, in use, the batten 250, banner support arm 252 and weighted cord 280 hold an upper edge and one side of the banner. Weight 262, at an operatively lower end of cord 280, serves to tension the cord and thus limit movement of the banner.

Weight 256 is attached to an upper end 232 of halyard 228. The halyard 228 passes, within an upper housing 214, over an upper halyard guide 220 (which may be a fairlead) and into a tubular elbow 254, which guides the halyard 228 into a secure internal cavity 226 of the pole 222. As described above with reference to the arrangement of FIG. 7, the halyard 228 passes downwards through the internal cavity 226 to reach tubular elbow 248, which guides the halyard 228 out of the internal cavity 226 and into a lower housing 212. Within the lower housing 212, the halyard 228 passes through a releasable halyard fastener 218. As mentioned above, a cam cleat may be used as the releasable halyard fastener 218. The remaining length of halyard 228 is positioned within an internal space of the lower housing 212. A lower end 230 of the halyard 228 may be attached within the lower housing 212. In the arrangement of FIG. 13, the lower housing 212 has a door which may opened or locked using a key. The lower housing thus serves to restrict unauthorised access to the halyard in order to raise or lower the banner.

The banner support system 210, made up of upper housing 214, conduit 260 and lower housing 212, is attached to the exterior surface of the pole 222. A support bracket 266 may be positioned on the pole to provide additional strength for the lower housing 212.

To attach a new banner or remove a currently-installed banner, an authorised person opens the lower housing 212 and releases the halyard 228 from the halyard fastener 218. The operator may then feed the halyard through the tubular elbows 248 and 254. Weights 256 moving in conduit 260 under gravity acts to lower the banner support arm 252. Preferably, the banner support system 210 is positioned on pole 222 such that when the banner support arm 252 is lowered, the banner support arm is easily reachable by the operator standing at ground level or on a step ladder. When the banner support arm 252 is lowered, the operator may insert batten 250 into the corresponding pocket in the banner, and clip the banner into the eyelets on glides 258 and eyelet 264 on weight 262. Then, by pulling the halyard 228 through the lower housing 212, the operator may raise the banner support arm 252 and the attached banner. When the banner support arm 252 has been raised to the desired position, the operator attaches halyard 228 using the releasable halyard fastener 218. The operator then closes and locks the lower housing 212, thus preventing unauthorised access to the halyard.

The height of lower housing 212 may be such that an operator can access the lower housing while standing at ground level. Alternatively, the operator may use a ladder to access the lower housing 212. While the use of a ladder may represent some inconvenience to the authorised operator, such an arrangement serves to place the lower housing 212 beyond easy reach of unauthorised persons.

Figure 14A:
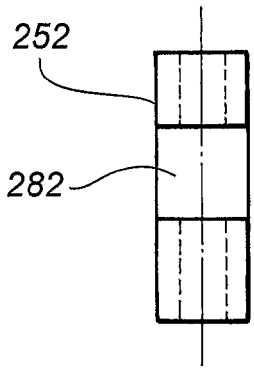
FIGS. 14A, B and C show end and side view of the swinging support arm in the arrangement of FIG. 13.
Figure 14B:
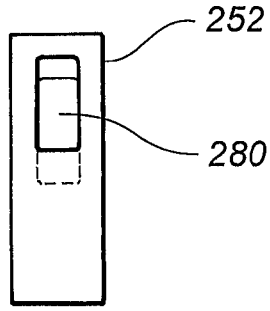
Figure 14C:
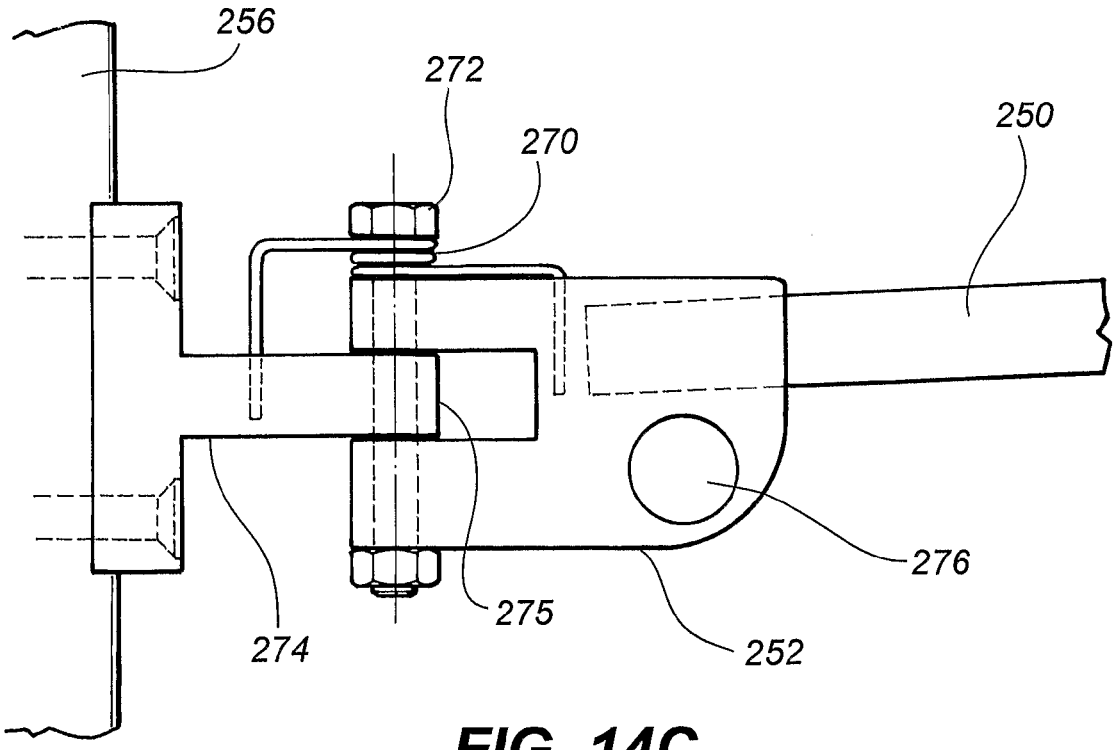

FIGS. 14A-14C show the pivoting attachment in greater detail. FIG. 14C shows a side view in which some hidden elements are shown in dashed outline. A gooseneck or T-section 274 is attached to weight 256. Support arm 252 has a generally rectangular cross section, as shown in FIGS. 14A and 14B. A slot 282 is formed in one end of the support arm 252. When assembled, an end 275 of the T-section 274 is positioned in slot 282 of the support arm 252. A bolt 272 passes through the support arm 252 and the end 275 of the T-section 274, thereby attaching the T-section 274 to the support arm 252. The bolt 272 acts as a pivot allowing the support arm 252 to rotate relative to the T-section 274.

Bolt 272 also holds a 2-way tension spring 270. One end of the tension spring 270 is attached to the T-section 274. The other end of the 2-way tension spring 270 is attached to the support arm 252. The support arm 252 may thus rotate relative to the T-section 274 and weight 256, about the axis defined by bolt 272. The tension spring 270 acts to return the support arm 252 to its original or equilibrium position after the arm has been rotated. Thus for example if a wind is blowing, the banner and support arm 252 may rotate with respect to the pole 222, spilling the wind. When the wind drops, the tension spring 270 acts to return the banner and support arm 252 to their original position.

Weight 262 attached to a lower end of the banner serves to hold the banner in an extended position, and is heavy enough to prevent excessive flapping of the banner. Attaching the banner to the eyelets on glides 258 also serves to stabilise the banner when positioned on the banner support system 210.

As seen in FIG. 14C, the support arm 252 also has a hole 276 which may accommodate a snap hook to further secure a banner to the support arm 252.

A slot 280 is formed in the support arm 252, at an opposite end to the slot 282 for accommodating the T-section 274. Slot 280 is sized to accommodate the batten 250. Batten 250 may be formed of fibreglass. In use, the batten 250 is inserted into slot 280 and also into an elongate pocket in the banner. The batten 250 thus holds the banner, in use, in an extended position to enhance the visibility of the banner. In one arrangement the batten is approximately orthogonal to the axis defined by conduit 260. However, the batten 250 may be configured at other angles relative to the conduit 260.

Figure 15:
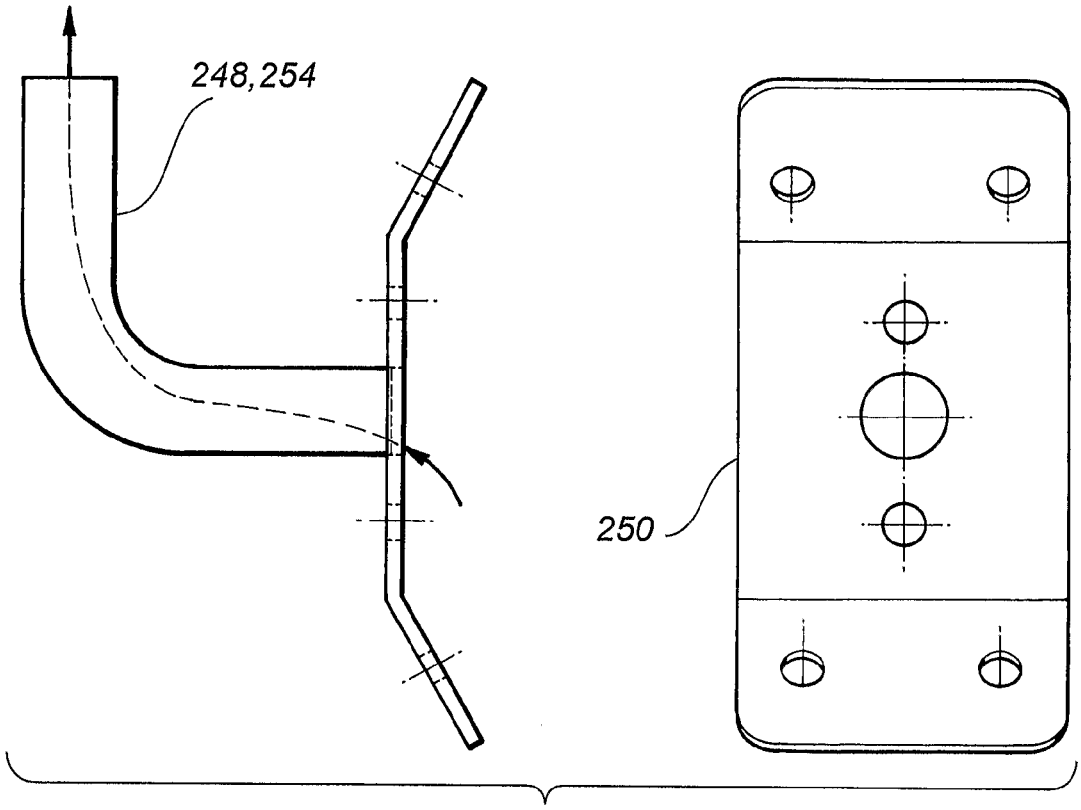
FIG. 15 shows a tubular elbow and plate for guiding the halyard in the arrangement of FIG. 13.

FIG. 15 shows a side view and end view of a part that may be used for the tubular elbows 248, 254. The tubular elbows are attached to a plate 250 that defines a plurality of holes which are used to attach the tubular elbow to the hole 222 or the cover support bracket 266. The holes defined in plate 250 may also be used to attach the upper halyard guide 220 of the releasable halyard fastener 218 to the plate 250.

Figure 16:
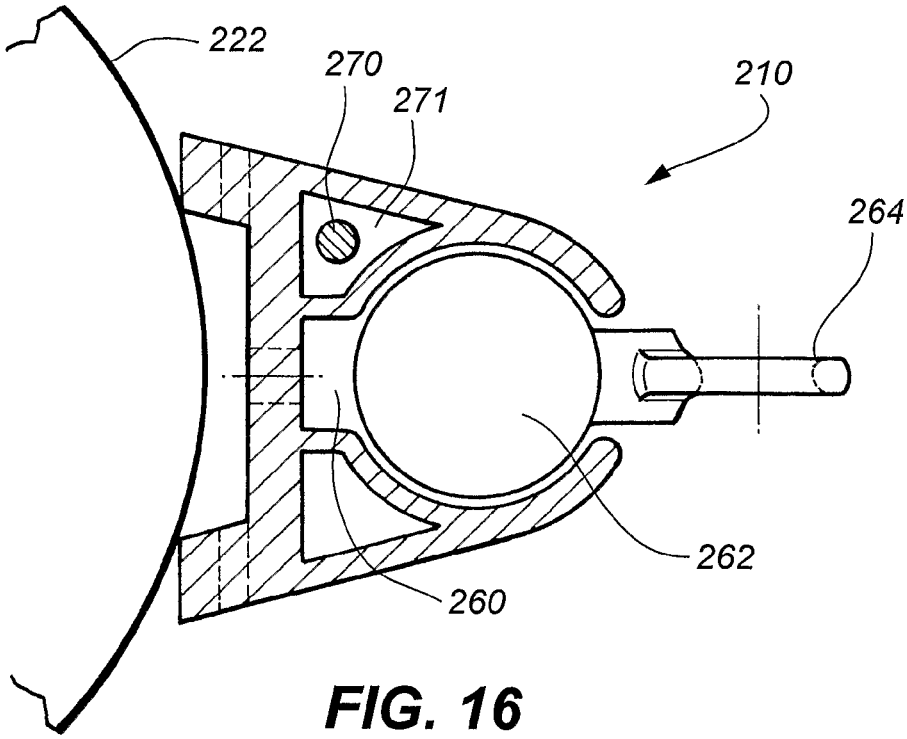
FIG. 16 shows a sectioned top view of an external conduit for use with the swinging support arm.

FIG. 13 shows an arrangement in which the banner support arm 252, weights 256, 262 and cord 280 are attached to a halyard 228 that passes through a secure internal cavity 226 of the pole 222. The swinging banner support arrangement may be also used in conjunction with a halyard that passes through a secure external conduit, as described with respect to FIGS. 1-6. This further illustrated in FIG. 16, which shows a sectioned top view of the banner support system 210. In the arrangement depicted, the banner support system 210 has a plurality of elongate conduits. Conduit 260 accommodates the weights 256, 262 and the cord 280. FIG. 16 shows a top view of a weight 262 with eyelet 264 attached. A halyard 270 extends along a conduit 271 formed in the banner support system 210. The arrangement of FIG. 16 does not require access to the interior of the pole 222. Conduit 260 has a longitudinal slot. Eyelet 264 protrudes through the longitudinal slot. Similarly, the T-section 274 protrudes through the longitudinal slot, the sides of which limit rotation of the T-section 274. The longitudinal slot may thus define the original or equilibrium position of the batten 250.

Figure 17:
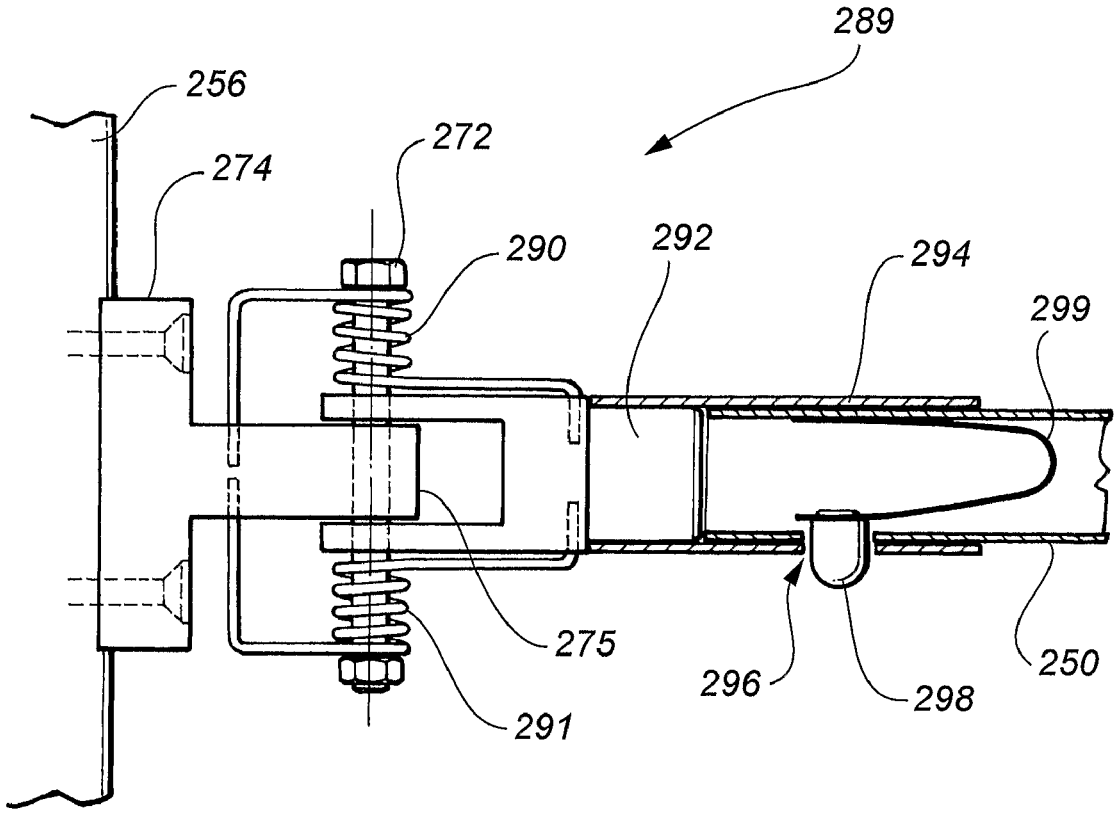
FIG. 17 shows an alternative arrangement for the swinging banner support arm of FIG. 14C using two springs.
Figure 18:
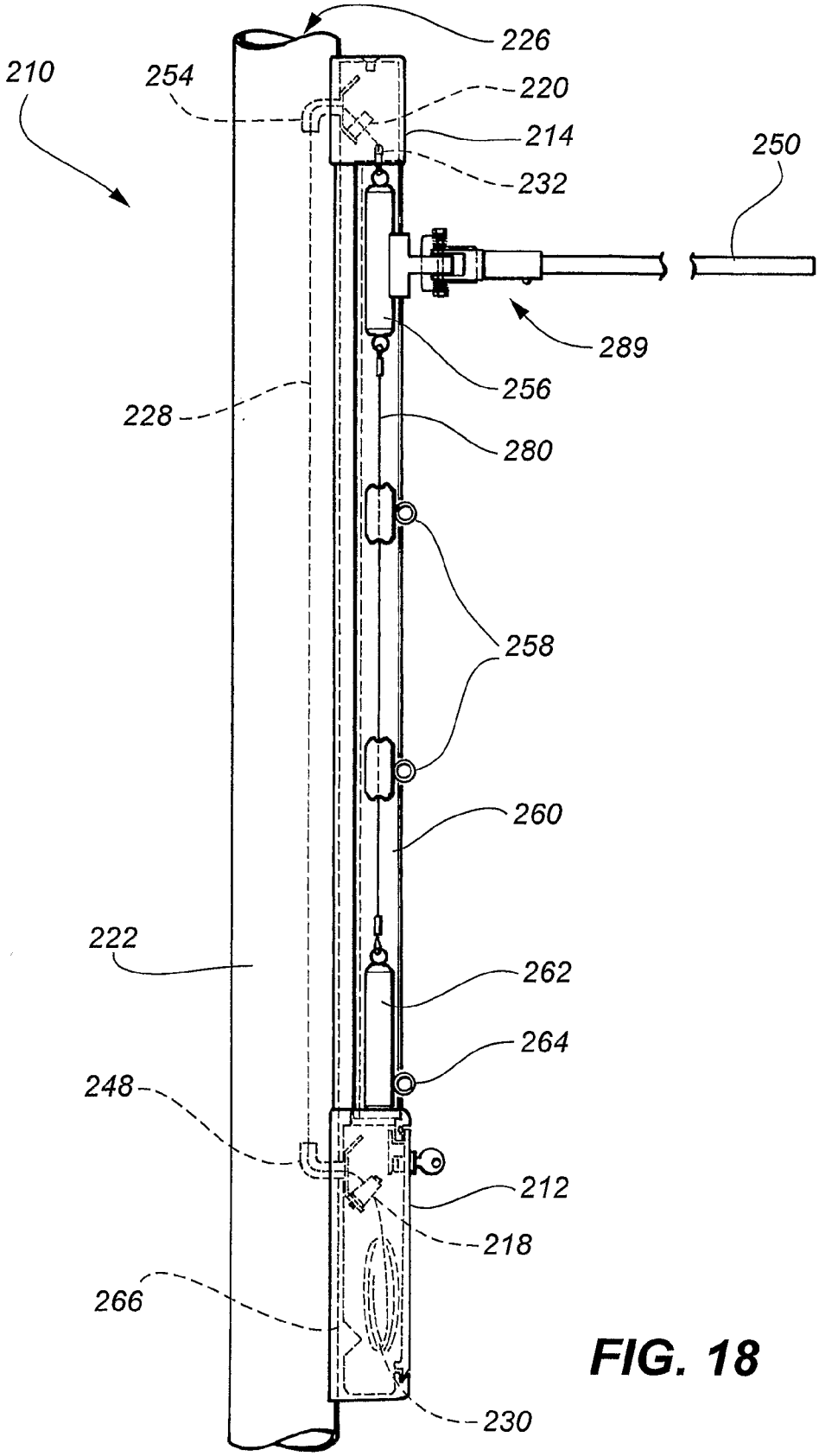
FIG. 18 shows the swinging banner support arm of FIG. 17 in use with the arrangement of FIG. 13.

FIGS. 17 and 18 show a further arrangement 289 of the pivoting attachment that uses two springs to urge the support arm back to an equilibrium position. As before, T-section 274 is attached to weight 256. The end 275 of the T-section 274 is positioned in a receiving slot formed in swinging banner support arm 292. Bolt 272 passes through an operatively upper spring 290, an upper portion of support arm 292, end 275 of T-section 274, a lower portion of support arm 292 and an operatively lower spring 291. The bolt 272 acts as a pivot allowing support arm 292 to rotate relative to the T-section 274. The springs 290, 291 are both attached to the T-section 274 and to the support arm 292. If the banner arm 292 is rotated about bolt 272 in either direction away from an equilibrium position, the springs act to urge banner arm 292 back towards the equilibrium position.

The swinging banner support arm 292 is pressed into a tube 294. Alternatively, the tube 294 and support arm 292 may be integrally formed. The support arm 292 and tube 294 may be formed of stainless steel. The tube 294 has an open end arranged to receive and support the batten 250. A hole 296 is defined in the side of tube 294 near the open end of the tube 294. In use, the hole 296 accommodates a button 298 formed in the batten 250. Spring 299 within the batten presses the button 298 away from the interior of the batten 250. When the batten 250 is positioned within tube 294, the button 298 and spring 299 act to retain the batten 250 in position.

A user may insert batten 250 into the tube 294 by depressing button 298 and sliding the batten 250 into the tube 294 such that the spring 299 presses button 298 through hole 296. To release the batten, the user presses button 298 through the hole 296 and slides the batten 250 out of the tube 294.

FIG. 18 shows the pivoting attachment 289 in use with the banner support arrangement 210. The batten 250 may be positioned in a pocket formed in the banner and serves to hold the banner in an open and readily visible configuration.

The above embodiments of the present invention are merely examples of the invention and other manners in which the various features can be arrange so as to allow the secure raising and lowering of a banner using a halyard are understood to fall within the spirit and scope of the present invention as claimed and described.

The invention disclosed and defined in this specification extends to all alternative combinations of two or more of the individual features mentioned or evident from the text or drawings. All of these different combinations constitute various alternative aspects of the present invention.

The invention disclosed and defined in this specification extends to all alternative combinations of two or more of the individual features mentioned or evident from the text or drawings. All of these different combinations constitute various alternative aspects of the present invention.

The term "comprises", its grammatical variants and any other words of similar effect, is used in this specification to mean "includes" and should not be taken as excluding the presence of other elements or features.

The invention claimed is:

1. A banner raising apparatus adapted to be used in conjunction with a halyard for raising and lowering a banner, the apparatus adapted to be mounted to a generally vertical support surface, the apparatus comprising:

(a) an elongate conduit defining a secure halyard passageway, the conduit adapted to be mounted to a support surface so as to extend generally vertically up the support surface;

(b) a halyard guide located at the operatively upper end of the elongate conduit for guiding a halyard travelling in the secure halyard passageway;

(c) a halyard fastener for releasably attaching the halyard to thereby restrain the banner in a raised position, the halyard fastener located at the operatively lower end of the elongate conduit; and (d) a secure housing located at the operatively lower end of the elongate conduit, the housing containing the halyard fastener and having an internal volume of sufficient capacity to contain a length of the halyard lowered in raising the banner to the operatively upper end of the elongate conduit, wherein the conduit comprises a plurality of passageways, one of which comprises the secure halyard passageway.

2. A banner raising apparatus as claimed in claim 1, wherein one of the passageways comprise a weight containment passageway, the weight containment passageway adapted to have a weight which is in use secured to the operatively lower end of a banner so as to weigh down the lower end of the banner, and also to facilitate dropping of the banner when the halyard is released.

3. A banner raising apparatus as claimed in claim 2, wherein a longitudinal slot is provided along at least substantially the full length of the elongate conduit through the wall of the conduit into the weight containment passageway to allow for connection of the lower end of the banner to the weight.

4. A banner raising apparatus as claimed in claim 3, wherein the elongate conduit has a series of fastening holes therein spread apart along the length of the conduit, the holes being adapted to receive fasteners for fastening the conduit to a support surface, the longitudinal slot being sufficiently wide to allow a fastener driving tool to engage and drive fasteners which in use will secure the elongate conduit to the support surface.

5. A banner raising apparatus as claimed in claim 2 comprising one or more glides movable in the weight containment passageway wherein, in use, an edge of the banner adjacent the elongate conduit is attached to the one or more glides.

6. A banner raising apparatus as claimed in claim 1, wherein the secure housing is configured such that a security release device is required to release the halyard from the halyard attachment means.

7. A banner raising apparatus as claimed in claim 6, wherein the secure housing is operable using the security release device.

8. A banner raising apparatus as claimed in claim 1, wherein the secure housing comprises an upper part having an opening shaped to couple with the operatively lower end of the elongate conduit so as to provide a passage into the secure housing for a halyard travelling in the elongate conduit, and a lower part, connectable to the upper part, the lower part being removable from the upper part in order to access the halyard in use.

9. A banner raising apparatus as claimed in claim 1 which includes an upper housing which connects to the operatively upper end of the conduit and which contains the halyard guide.

10. A banner raising apparatus as claimed in claim 1, wherein the elongate conduit comprises an extruded metal section.

11. A banner raising apparatus as claimed in claim 1, wherein the secure housing comprises a fabricated or cast metal housing, having an open side which, in use, sits against the support surface.

12. A banner raising apparatus as claimed in claim 1, wherein the halyard fastener comprises a cam cleat.

13. A banner raising apparatus as claimed in claim 1, wherein the halyard guide comprises a fairlead.

14. A banner raising apparatus as claimed in claim 1 comprising an elongate banner support member that in use extends laterally from the support surface, the banner support member being adapted to have a banner suspended therefrom when in a raised position.

15. A banner raising apparatus as claimed in claim 14, further comprising pivoting attachment means to support the banner support member.

16. A banner raising apparatus adapted to be used in conjunction with a halyard for raising and lowering a banner, the apparatus adapted to be mounted to a generally vertical support surface, the apparatus comprising:

(a) an elongate conduit, the conduit adapted to be mounted to a support surface so as to extend generally vertically up the support surface, the elongate conduit comprising a secure halyard passageway and a weight containment passageway, the weight containment passageway adapted to contain a weight which in use is secured to the operatively lower end of a banner so as to weigh down the lower end of the banner and also to facilitate dropping of the banner when the halyard is released;

(b) an elongate banner support member that operatively extends generally orthogonally from the elongate conduit, the banner support member being adapted to be raised and lowered by the halyard and being adapted to have a banner suspended therefrom when in a raised position (c) a halyard fastener for releasably attaching the halyard, the halyard fastener located at the operatively lower end of the elongate conduit, wherein fastening the halyard to the halyard fastener restrains the banner in a raised position; and (d) a secure housing located at the operatively lower end of the elongate conduit, the housing containing the halyard fastener and having an internal volume of sufficient capacity to contain a length of the halyard lowered in raising the banner support member to the operatively upper end of the elongate conduit.

* * * * *